US007618271B2

(12) United States Patent
Shiga

(10) Patent No.: US 7,618,271 B2
(45) Date of Patent: Nov. 17, 2009

(54) LEVER-TYPE CONNECTOR

(75) Inventor: Katsumi Shiga, Chiba (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 12/186,871

(22) Filed: Aug. 6, 2008

(65) Prior Publication Data

US 2009/0042423 A1 Feb. 12, 2009

(51) Int. Cl.
*H01R 13/62* (2006.01)

(52) U.S. Cl. ..... 439/157

(58) Field of Classification Search ..... 439/157, 439/152, 159, 160
See application file for complete search history.

(56) References Cited

U.S. PATENT DOCUMENTS 5,681,175 A * 10/1997 Busse et al. ..... 439/157
5,785,540 A 7/1998 Jaklin
6,213,795 B1 * 4/2001 Drescher et al. ..... 439/157
6,361,356 B1 * 3/2002 Heberlein et al. ..... 439/489
7,004,769 B1 * 2/2006 Putnam et al. ..... 439/157
7,070,438 B2 * 7/2006 Dillon ..... 439/347
7,351,078 B2 4/2008 Winkler et al.
7,361,036 B2 * 4/2008 Pittenger et al. ..... 439/157
2006/0040536 A1 * 2/2006 Putnam et al. ..... 439/157
2007/0099461 A1 * 5/2007 Pittenger et al. ..... 439/157

FOREIGN PATENT DOCUMENTS

JP 09-115605 5/1997

OTHER PUBLICATIONS

Japanese Office Action dated May 19, 2009, issued by the JPO for the corresponding Japanese Patent Application No. 2007-209483.

* cited by examiner

*Primary Examiner*—Gary F. Paumen
(74) *Attorney, Agent, or Firm*—Barley Snyder LLC

(57) ABSTRACT

Slide members in the lever-type connector are respectively provided with resilient latch arms and respectively have latching projections that latch on the corresponding drive projections during the temporary mating with the mating connector. Each of the resilient latch arms is formed between a pair of slits respectively extending from specified points which are located in the end portion of one of the cam grooves toward the corresponding entrance where the corresponding drive projection enters and on the side opposite from the side of the entry of the corresponding drive projection so as to undergo elastic deformation in the direction of thickness of the slide member.

9 Claims, 18 Drawing Sheets

(B)

(A)

LEVER-TYPE CONNECTOR

CROSS-REFERENCE TO RELATED APPLICATIONS

This application claims the benefit of the filing date under 35 U.S.C. § 119(a)-(d) of Japanese Patent Application No. 2007-209483, filed Aug. 10, 2007.

FIELD OF THE INVENTION

The present invention relates to an electrical connector and more particularly to a lever-type electrical connector.

BACKGROUND

There are cases in which a connector having numerous contacts mates with a mating connector. Here, as the number of the contacts increases, the force required for mating the connectors is increased further and further. In order to reduce the mating force of these connectors, lever-type connectors have been known which are devised such that one connector is provided with a slide member having a cam groove that engages with a projection provided on a mating connector, and a lever that drives this slide member.

With such a lever-type connector, temporary mating between connectors is performed because there are cases in which the connectors break unless the lever is driven after being temporarily mated.

The lever-type connector shown in FIGS. 16 through 19 (see JP-A-09-115,605), for example, is known as such a lever-type connector. FIG. 16 is a side view showing a conventional lever-type connector and a mating connector prior to mating. FIG. 17 is a side view showing them temporarily mated. FIG. 18 is an enlarged view in the vicinity of the entrance of a cam groove at the time of the temporary mating. FIG. 19 is a partial sectional view along line 19-19 in FIG. 17.

The lever-type connector 101 shown in FIGS. 16 and 17 is designed to mate with a mating connector 150, and comprises a substantially rectangular housing 110 to which a plurality of contacts (not shown) are attached, a slide member 120, and a lever 130.

Here, as is shown in FIG. 19, the housing 110 has a cavity 115 that receives the mating connector 150. A pair of slide member receiving passages 111 extending in a direction orthogonal to the direction of mating are provided in the side walls of the housing 110. Legs of the slide member 120 are received in a movable manner in these slide member receiving passages 111.

A plurality of cam grooves 121 that respectively engage with drive projections 152 provided on the mating connector 150 are formed in the legs of the slide member 120 as shown in FIGS. 16 through 19.

The lever 130 is attached to the housing 110 so as to pivot about the pivoting shaft 131. The lever 130 causes the slide member 120 to move inside the slide member receiving passages 111 as a result of the pivoting. Specifically, the lever 130 pivots about the pivoting shaft 131 in the direction of arrow A from the initial position shown in FIG. 17 to the final position (not shown). Here, the lever 130 causes the slide member 120 to move forward (leftward in FIG. 17) from the initial position shown in FIG. 17 to the final position. Conversely, the lever 130 pivots about the pivoting shaft 131 in the direction opposite from the direction of arrow A from the final position to the initial position. Here, the lever 130 causes the slide member 120 to move rearward from the final position to the initial position.

In addition, a plurality of resilient latch arms 113 are provided on the lower end portions of the side walls of the housing 110 as shown in FIGS. 17 and 18. The positions in the forward-rearward direction of the housing 110 where the respective resilient latch arms 113 are provided are positions corresponding to the entrances of the respective cam grooves 121 when the slide member 120 is located in the initial position. As is shown in FIG. 18, slits 112 that pass through from the outer surfaces of the side walls of the housing to the slide member receiving passages 111 are formed on both the front and rear sides of the individual resilient latch arms 113, and each resilient latch arm 113 elastically deforms in the inward-outward direction (left-right direction in FIG. 19). A latching projection 114 that protrudes inward as shown in FIG. 19 is provided at the lower end portion of each resilient latch arm 113.

When the lever 130 and slide member 120 are in the initial position, the mating housing 151 of the mating connector 150 is inserted into the cavity 115 in the housing 110. Then, as is shown in FIG. 19, the latching projections 114 of the resilient latch arms 113 respectively ride over the drive projections 152 provided on the mating connector 150, and are positioned underneath the drive projections 152, and the drive projections 152 respectively enter the entrances of the cam grooves 121 formed in the slide member 120. This position is referred to as being temporarily mated. When temporarily mated, the drive projections 152 of the mating connector 150 are prevented from slipping out by the latching projections 114, so that the lever-type connector 101 is prevented from dropping out of the mating connector 150.

Furthermore, when temporarily mated, the lever 130 may then pivot to the final position in the direction of arrow A in FIG. 17. Then, the slide member 120 moves to the final position, and the lever-type connector 101 is pulled in toward the mating connector 150 in cooperation with the cam grooves 121 and drive projections 152, thus completing the mating between the two connectors 101 and 150.

However, this lever-type connector 101 is constructed such that the resilient latch arms 113 provided on the outer walls of the housing 110 elastically deform during temporary mating. Therefore, the rigidity of the housing 110 is low, and in cases where the insertion is to be performed at an angle with respect to the mating connector 150, there is a danger that the housing 110 will be expanded, so that the lever-type connector 101 will end up being diagonally inserted into the mating connector 150. If the lever 130 is caused to pivot such that the lever-type connector 101 is obliquely inserted into the mating connector 150, an excessive force is applied to the mating part, so that there is the risk of the two connectors 101 and 150 being destroyed.

On the other hand, in order to avoid lowering of the rigidity of the housing 110, if the housing 110 is not provided with any resilient latch arms 113, and instead, the latching projections 114 are provided on the lower end portions of the outer walls of the housing 110 or the lower end portions of the slide member 120, then the drive projections 152 of the mating connector 150 respectively contact the latching projections 114 and the housing 110 flexes on temporary mating. In this case, because the rigidity of the housing 110 is high, the force required for temporary mating is large, thus creating the problem of difficulty in the mating between the two connectors 101 and 150.

The lever-type connector shown in FIG. 20, for example, has been developed as a connector which prevents such oblique insertion into the mating connector 150 during temporary mating, and which avoids the difficulty in the mating between the two connectors 101 and 150. FIG. 20 is a sectional view cut along the forward-rearward direction, showing a state in which a conventional lever-type connector temporarily mates with a mating connector.

A pair of slide member receiving spaces 211 are formed in the housing 210 of the lever-type connector 201 shown in FIG. 20. A slide member 220 is installed in a movable manner in each of the slide member receiving spaces 211. A plurality of resilient latch arms 222 are provided on each slide member 220. Latching projections 223 that respectively latch on drive projections 252 provided on a mating housing 251 during temporary mating with a mating connector 250 are provided at the tip ends of the respective resilient latch arms 222.

These resilient latch arms 222 extend in the vertical direction in the rear portions (left portions in FIG. 20) of cam grooves 221 on the side of entrances 224 where the drive projections 252 respectively enter, and the resilient latch arms 222 elastically deform in an in-plane direction (in the forward-rearward direction) of the slide members 220.

Thus, as a result of the resilient latch arms 222 being provided on the slide members 220, the rigidity of the housing 210 is not lowered, so that diagonal insertion with respect to the mating connector 250 can be prevented during the temporary mating with the mating connector 250. Moreover, only the resilient latch arms 222 undergo elastic deformation during the temporary mating, and the insertion into the mating connector 250 does not have to cause any flexing of the housing 210. Accordingly, the mating operation of the two connectors 201 and 250 can be performed easily without requiring a large amount of force.

However, the following problems are encountered in this conventional lever-type connector 201 shown in FIG. 20. Specifically, the resilient latch arms 222 are constructed so as to elastically deform in an in-plane direction of the slide members 220, and in order to have the appropriate amount of displacement and elastic force at the time of the elastic deformation, a certain length is required in the vertical direction.

However, the installation positions of the resilient latch arms 222 are restricted by the positional relationship with the cam grooves 221. That is, the resilient latch arms 222 are installed by avoiding the cam grooves 221, so that the height of the slide members 220 (the length in the vertical direction) cannot be reduced.

SUMMARY

Accordingly, the present invention was devised in light of the problems described above. It is an object of the present invention, among others, to provide a lever-type connector that achieves both ease of mating and prevention of oblique insertion during temporary mating and that can also achieve a reduction in the height of the slide member, which in turn makes a low profile of this connector possible.

The lever-type connector of the invention has a housing having a contact, a slide member having a cam groove that engages with a drive projection provided on a mating connector, and a lever that drives the slide member. The slide member is provided with a resilient latch arm having a latching projection that latches on the drive projection during temporary mating with the mating connector. The resilient latch arm has a latching projection at the tip end thereof and is formed between a pair of slits respectively extending from specified points which are located in the end portion of the cam groove toward the entrance where the drive projection enters and on the side opposite from the side of the entry of the drive projection so as to elastically deform in the direction of thickness of the slide member.

BRIEF DESCRIPTION OF THE DRAWINGS

The invention will now be described by way of example with reference to the accompanying figures of which.

DETAILED DESCRIPTION OF THE EMBODIMENTS

Figure 1B:
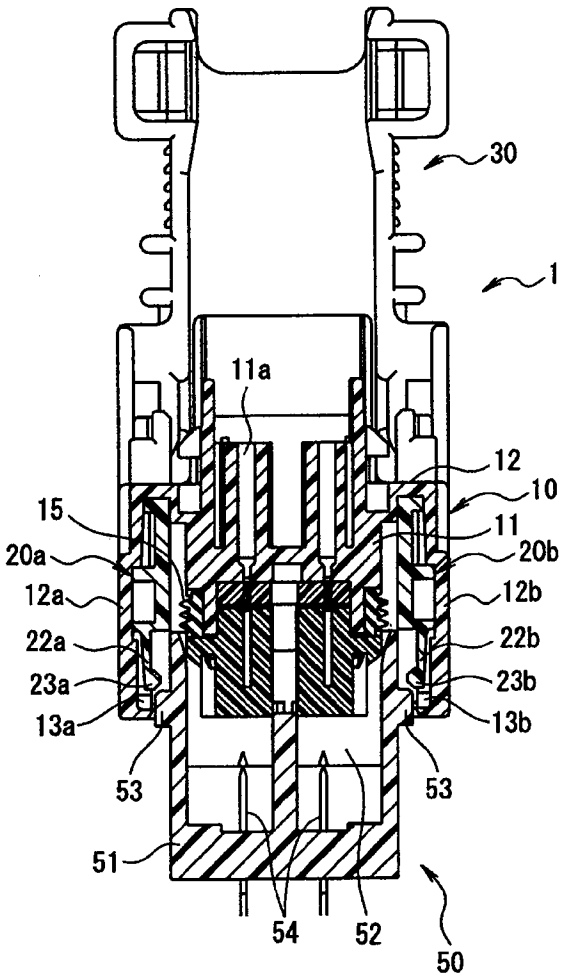
FIG. 1B is a sectional view along line IB-IB in FIG. 1A.

An embodiment of the present invention will be described below with reference to the figures. As shown in FIGS. 1A through 3B, a lever-type connector 1 and a mating connector 50 mate with each other. The mating connector 50 comprises a substantially rectangular insulating mating housing 51 and a plurality of mating contacts 54 made of metal that are attached to the mating housing 51 as shown in FIGS. 1A through 3B. A mating part receiving recess 52 which receives a mating part 11 that is provided on the housing 10 of the lever-type connector 1 is formed in the interior of the mating housing 51. Furthermore, a plurality of drive projections 53 are formed on the outer surfaces of the left and right side walls (left and right side walls in FIG. 1B) of the mating housing 51.

As is shown in FIGS. 4 through 12C, the lever-type connector 1 comprises an insulating housing 10, a set of two slide members, left and right slide members 20*a* and 20*b*, and a lever 30.

Figure 4:
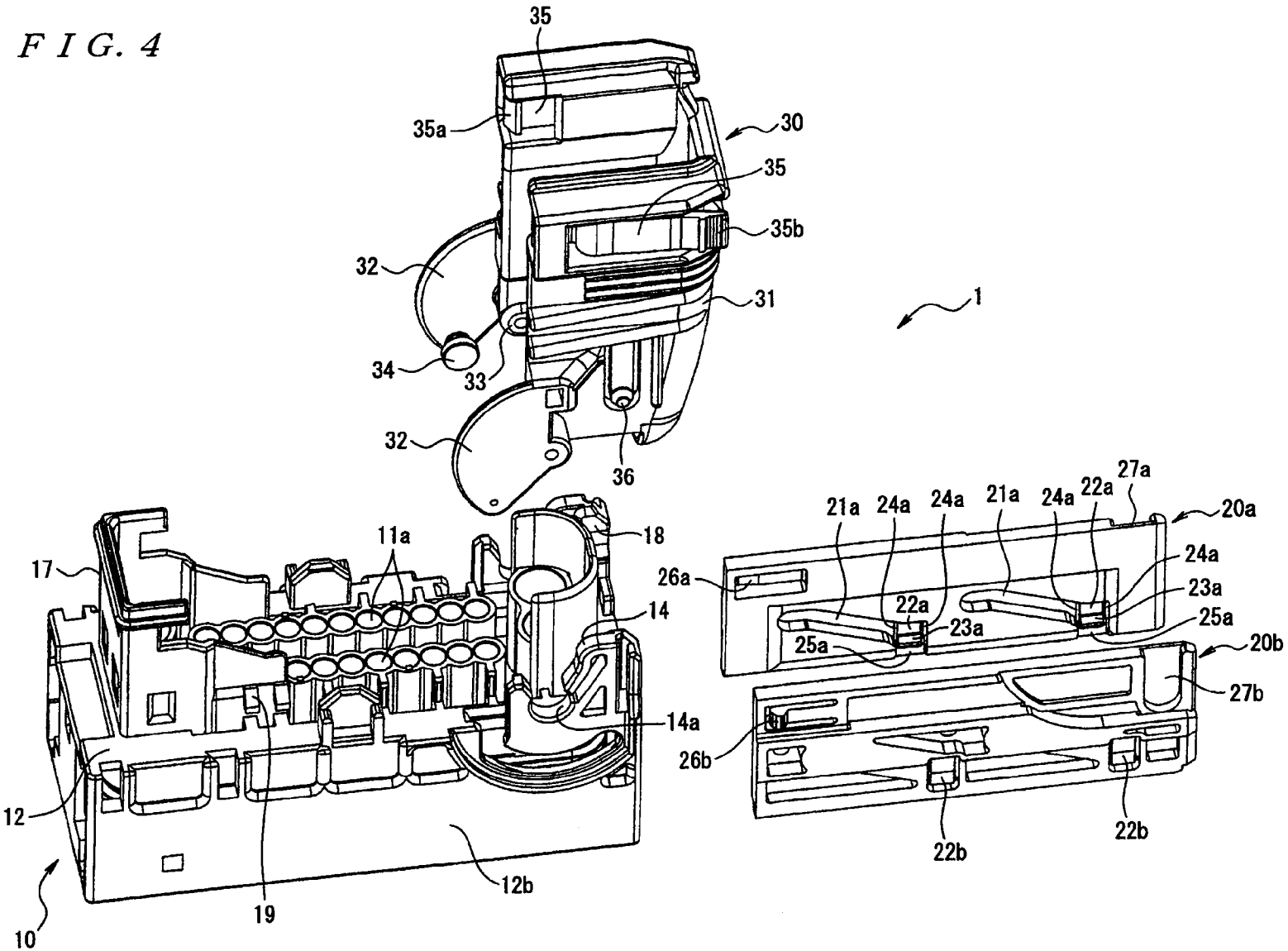
FIG. 4 is an exploded perspective view of the lever-type connector shown in FIGS. 1A through 3B.
Figure 5A:
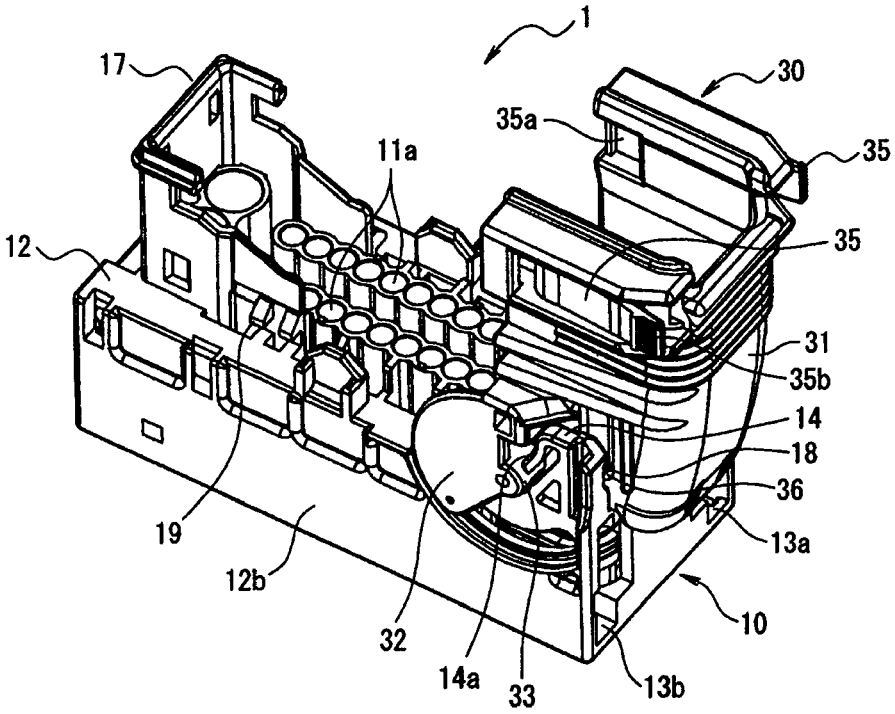
FIG. 5A is a perspective view of the connector as seen from above at an angle from the right side surface, in which the lever is located in the initial position.
Figure 5B:
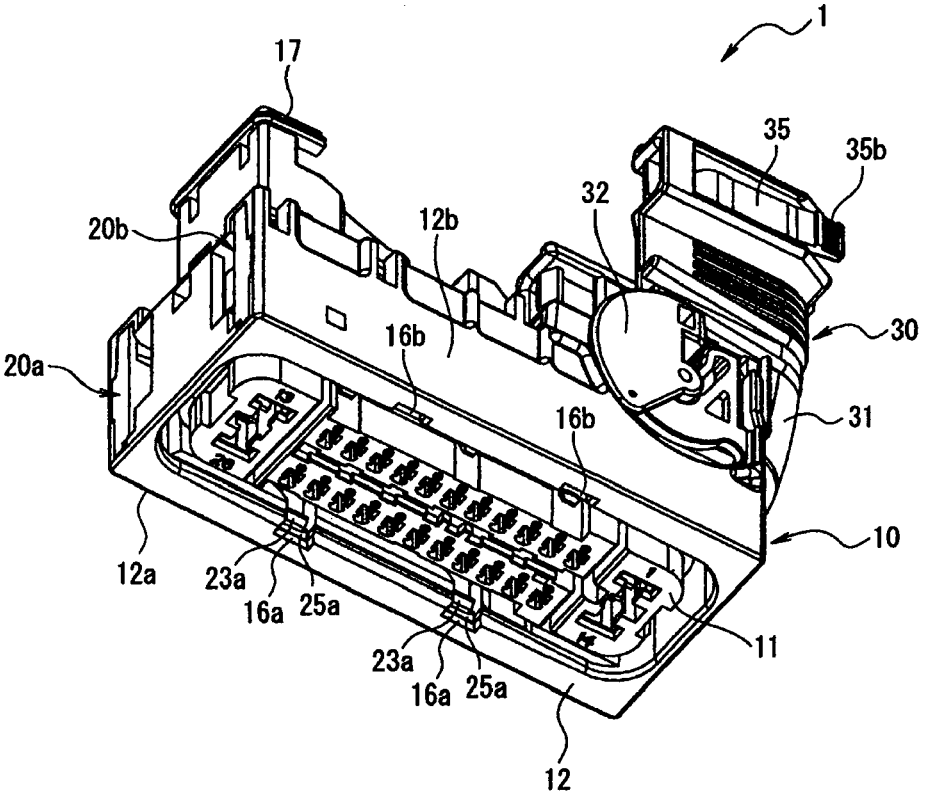
FIG. 5B is a perspective view of the connector as seen from below at an angle from the right side surface in which the lever is located in the initial position.
Figure 6A:
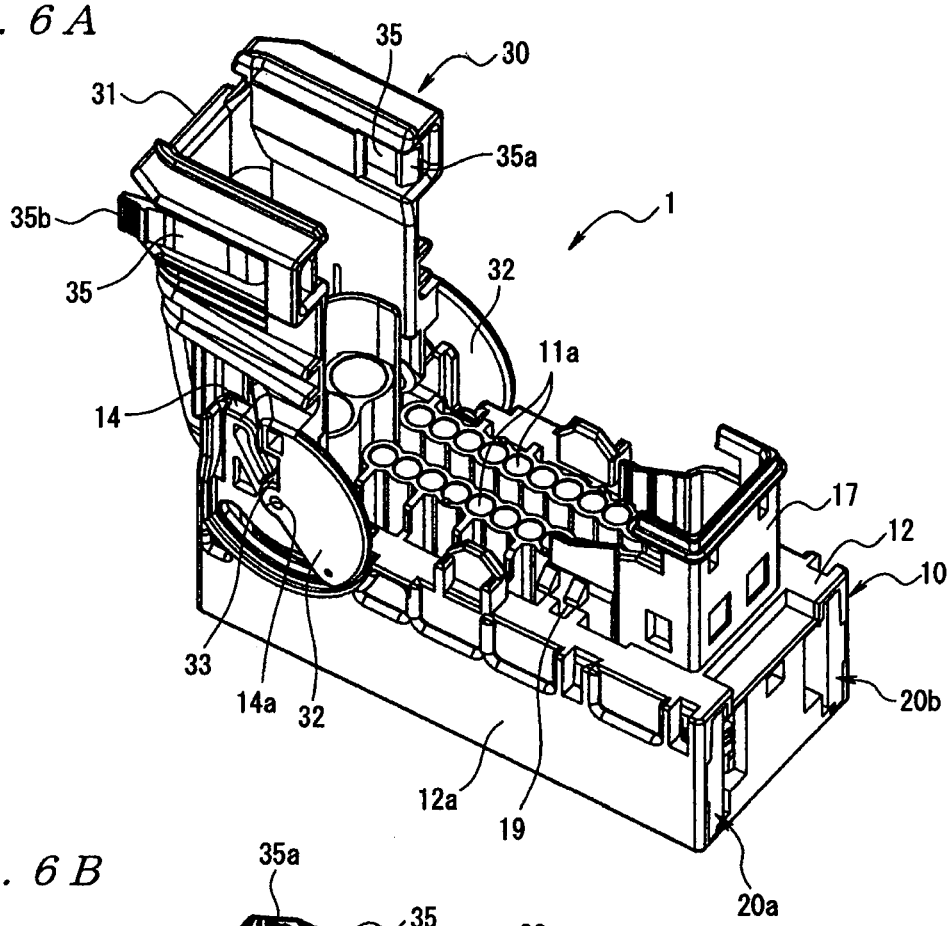
FIG. 6A is a perspective view of the connector as seen from above at an angle from the left side surface in which the lever is located in the initial position.
Figure 6B:
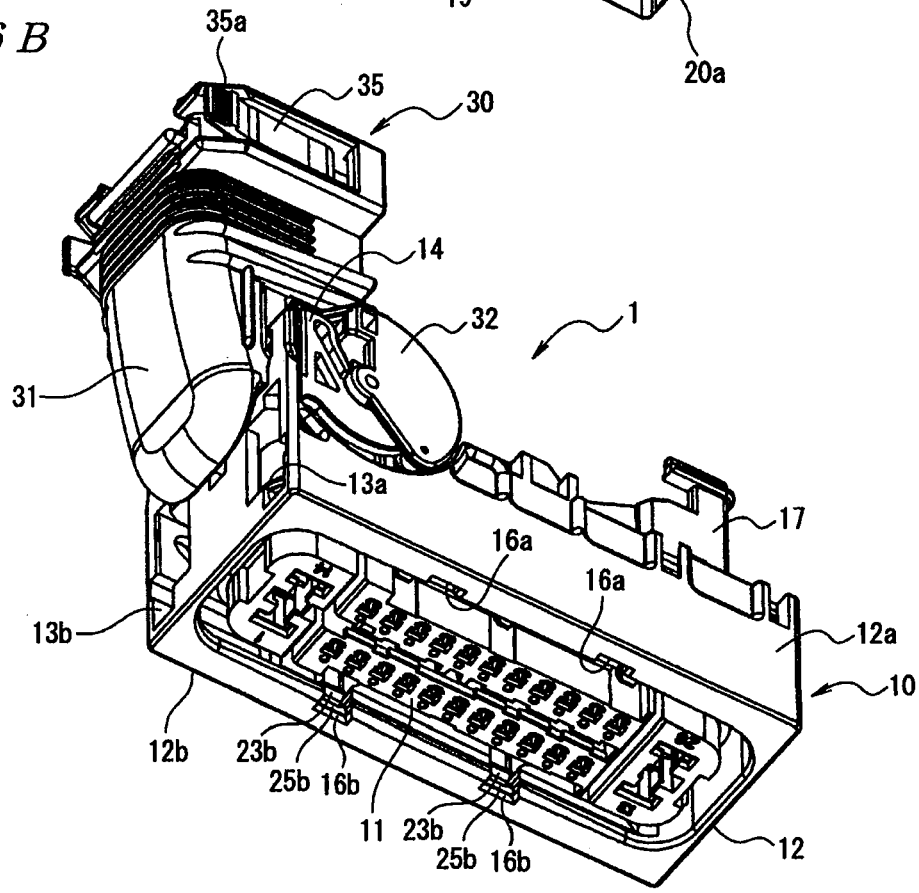
FIG. 6B is a perspective view of the connector as seen from below at an angle from the left side surface in which the lever is located in the initial position.
Figure 7A:
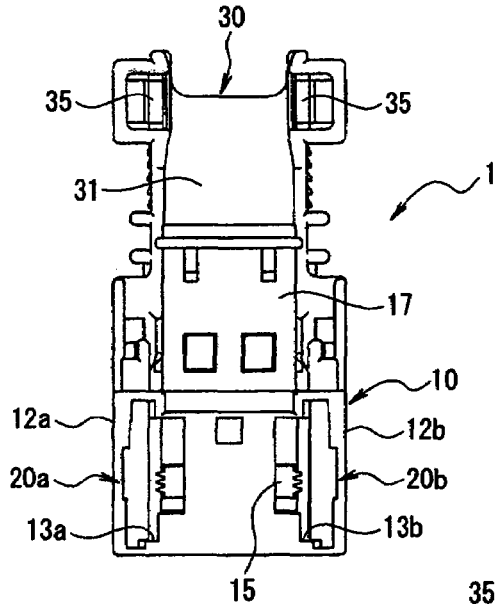
FIG. 7A is a front view of the connector.
Figure 7B:
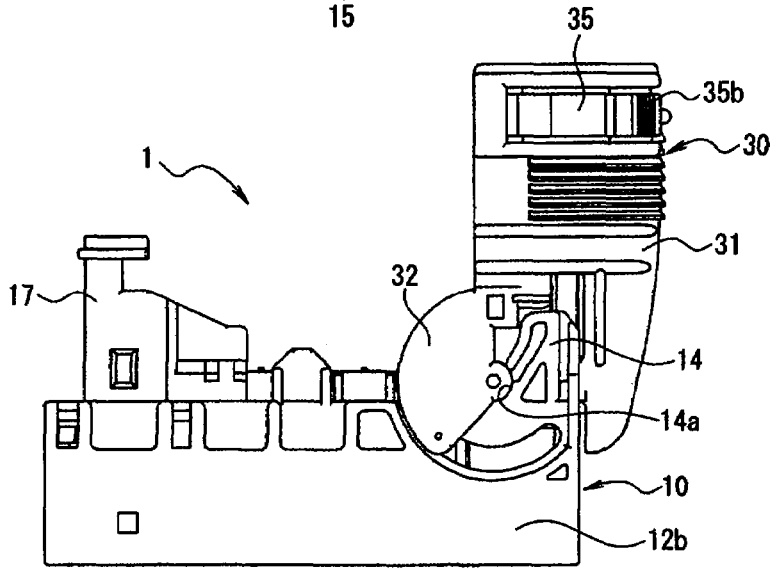
FIG. 7B is a right side view of the connector.
Figure 7C:
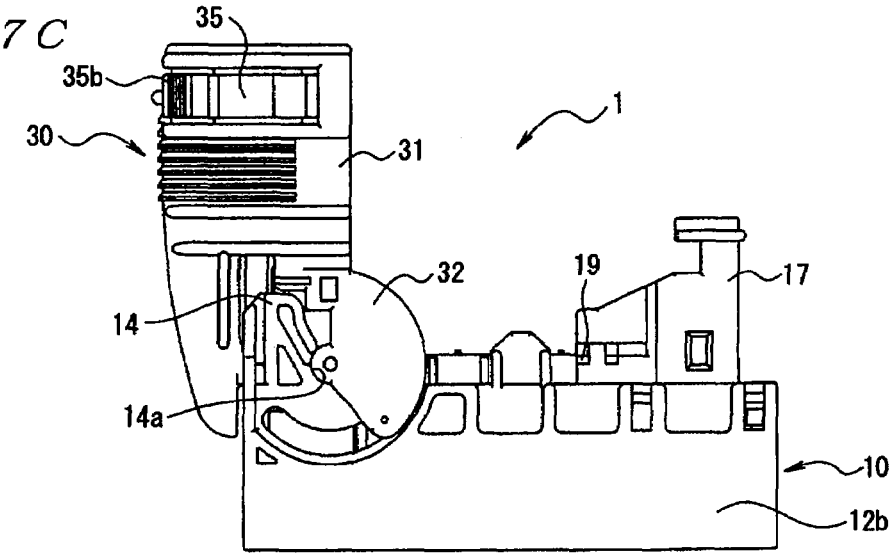
FIG. 7C is a left side view of the connector.
Figure 8C:
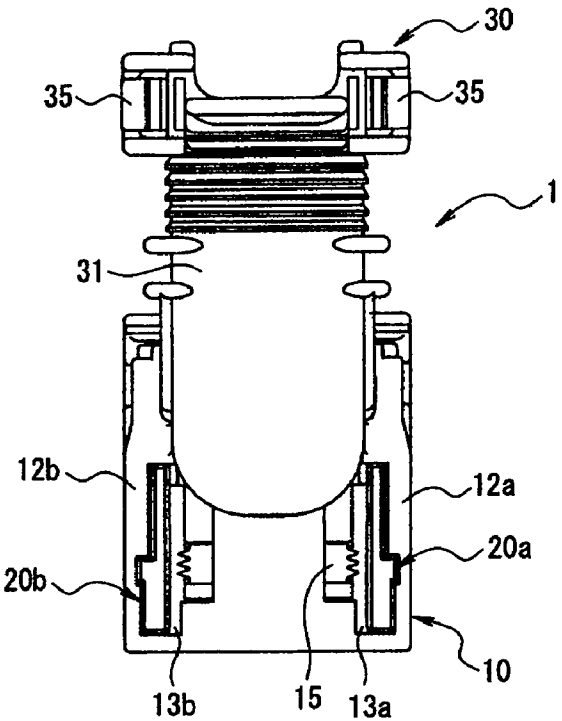
FIG. 8C is a rear view of the connector in which the lever is located in the initial position.
Figure 8B:
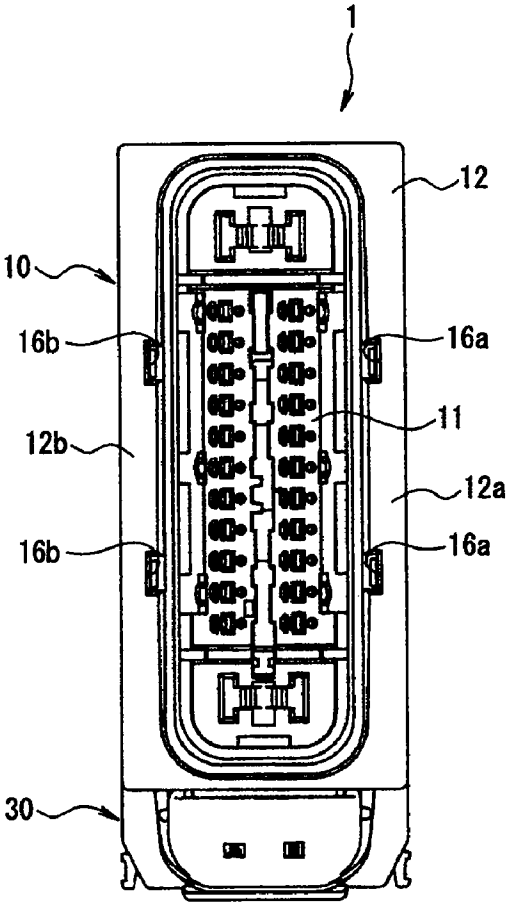
FIG. 8B is a bottom view of the connector in which the lever is located in the initial position.
Figure 8A:
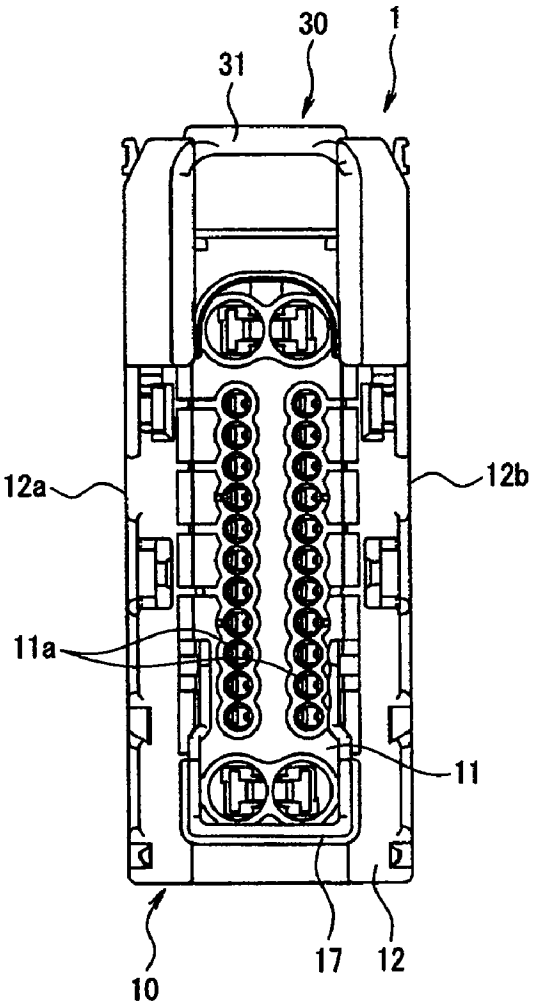
FIG. 8A is a plan view of the connector in which the lever is located in the initial position.
Figure 9A:
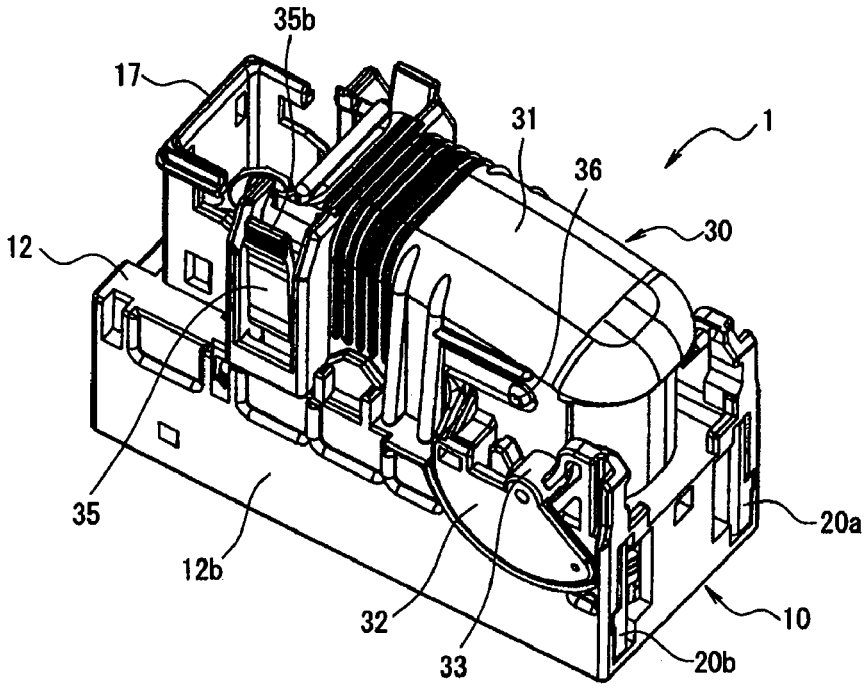
FIG. 9A is a perspective view as seen from above at an angle from the right side surface in which the lever is located in the final position.
Figure 9B:
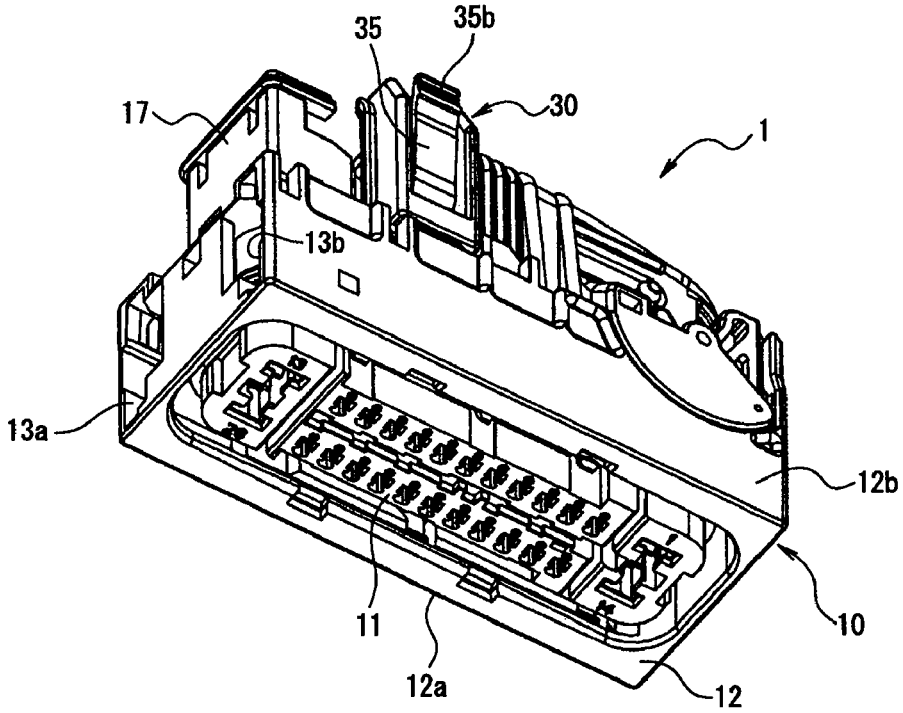
FIG. 9B is a perspective view as seen from below at an angle from the right side surface in which the lever is located in the final position.
Figure 10A:
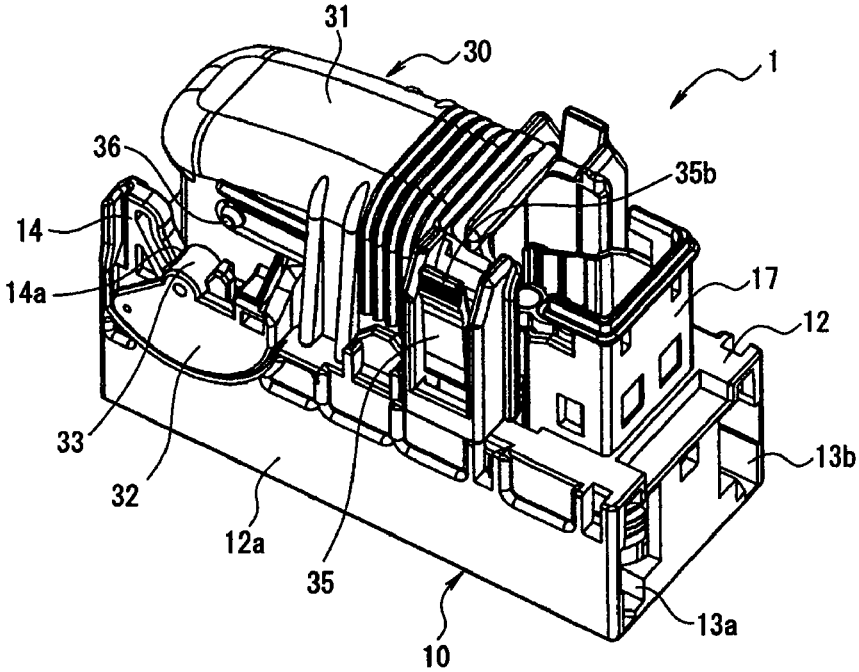
FIG. 10A is a perspective view as seen from above at an angle from the left side surface in which the lever is located in the final position.
Figure 10B:
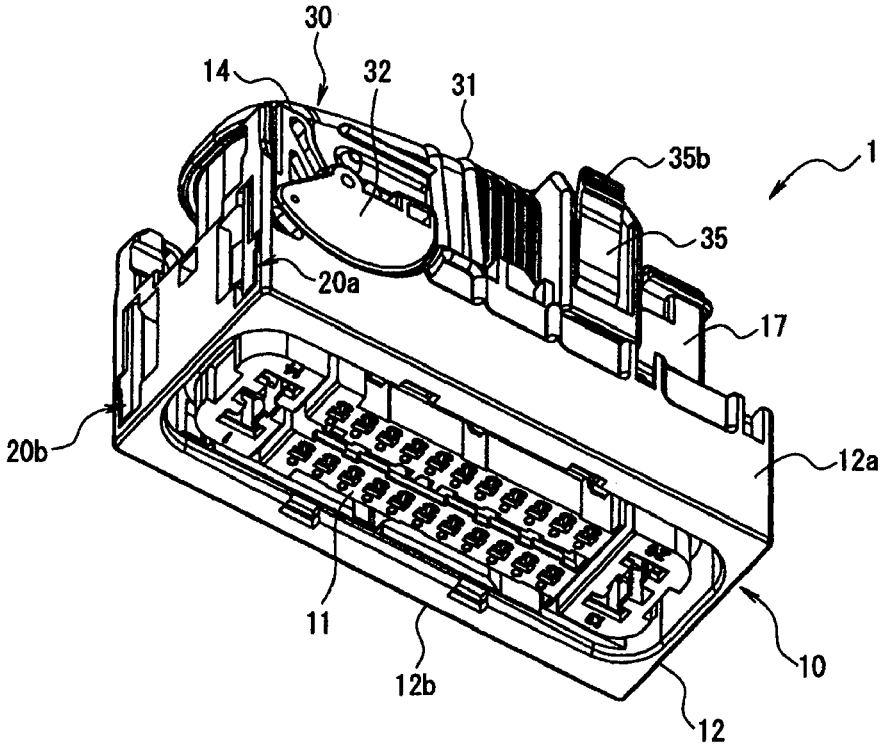
FIG. 10B is a perspective view as seen from below at an angle from the left side surface in which the lever is located in the final position.
Figure 11A:
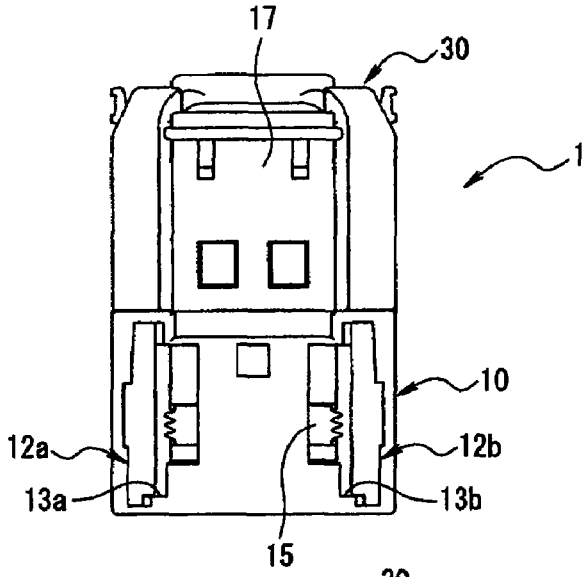
FIG. 11A is a front view of the connector in which the lever is located in the final position.
Figure 11B:
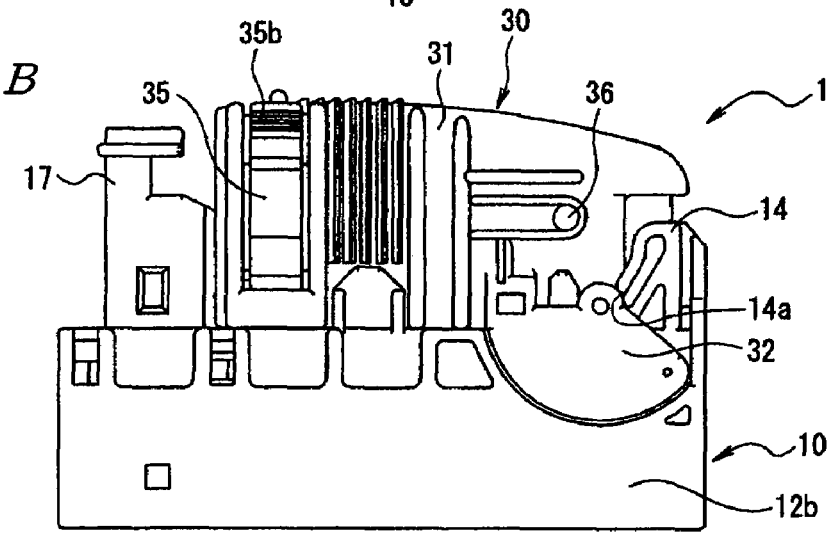
FIG. 11B is a right side view of the connector in which the lever is located in the final position.
Figure 11C:
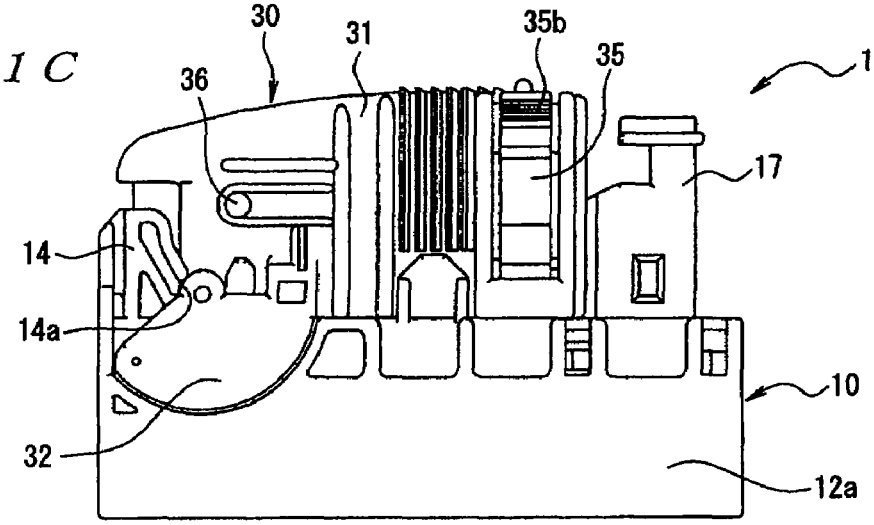
FIG. 11C is a left side view of the connector in which the lever is located in the final position.
Figure 12C:
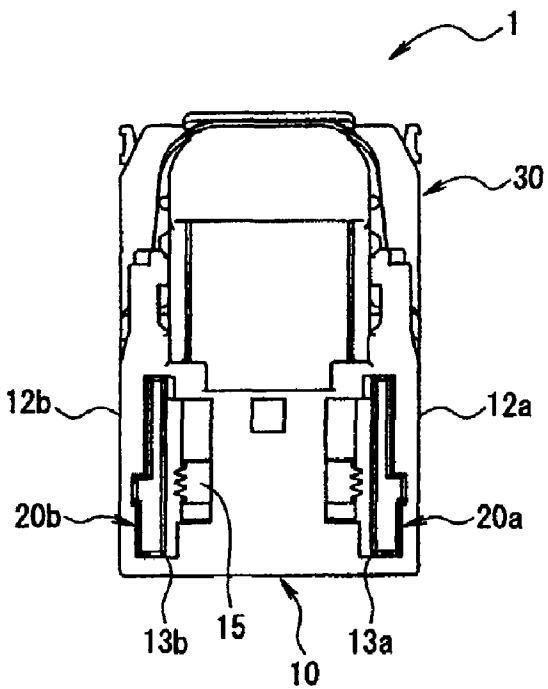
FIG. 12C is a rear view of the connector in which the lever is located in the final position.
Figure 12B:
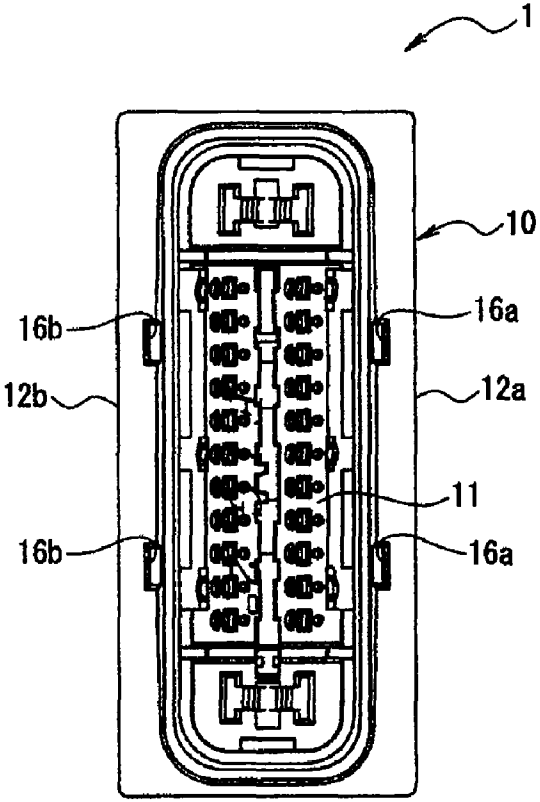
FIG. 12B is a bottom view of the connector in which the lever is located in the final position.
Figure 12A:
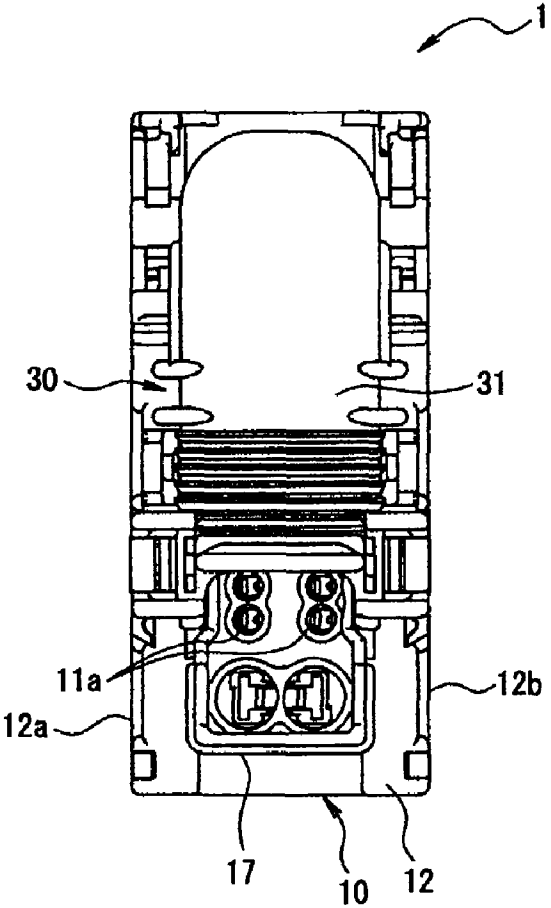
FIG. 12A is a plan view of the connector in which the lever is located in the final position.
Figure 13A:
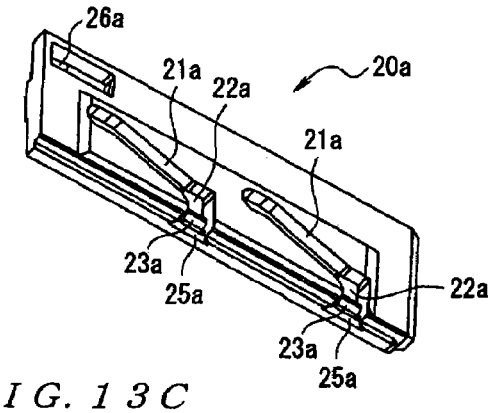
FIG. 13A is a perspective view of the left-side slide member as seen from below at an angle from the right side surface.
Figure 13B:
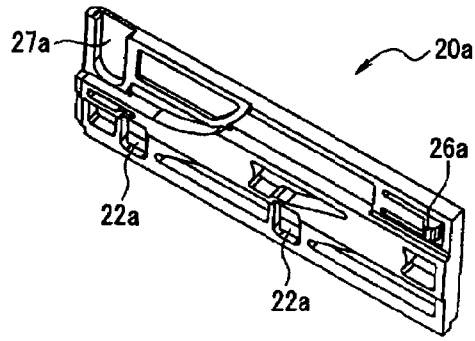
FIG. 13B is a perspective view of the left-side slide member as seen from above at an angle from the left side surface.
Figure 13C:
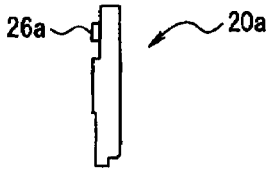
FIG. 13C is a front view of the left-side slide member.
Figure 13D:
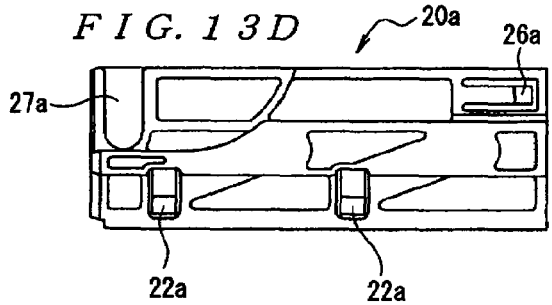
FIG. 13D is a left side view of the left-side slide member.
Figure 13E:
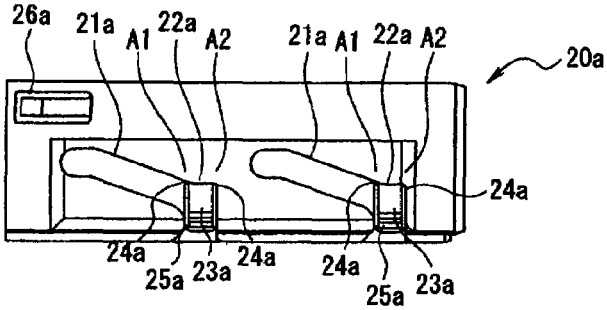
FIG. 13E is a right side view of the left-side slide member.
Figure 13F:
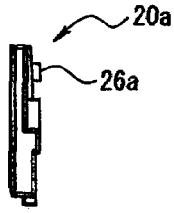
FIG. 13F is a rear view of the left-side slide member.
Figure 13G:
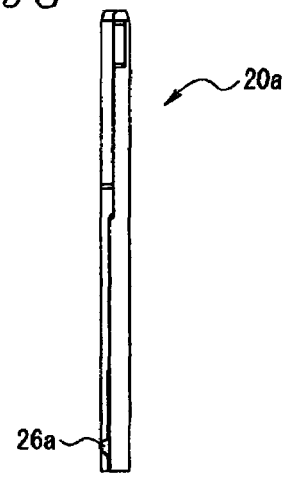
FIG. 13G is a plan view of the left-side slide member.
Figure 13H:
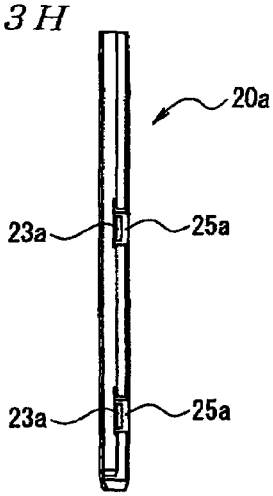
FIG. 13H is a bottom view of the left-side slide member.

The housing 10 comprises a substantially rectangular mating part 11 that is received inside the mating part receiving recess 52 in the mating connector 50 as clearly shown in FIG. 1B, and an outer housing part 12 that covers the periphery of the mating part 11 as clearly shown in FIGS. 1B and 8B. The housing 10 is formed by molding an insulating resin. A plurality of contacts (not shown in the Figures) is received in the mating part 11. Electrical wires (not shown in the figures) connected to the respective contacts are led out upward (upward in FIG. 1B) by passing through electrical wire lead-out holes 11*a* that are clearly shown in FIGS. 1B and 4. Furthermore, a left-side slide member receiving space 13*a* is formed on the inside of the left side wall 12*a* of the outer housing part 12 as clearly shown in FIGS. 1B, 5A, 6B, 7A, and 8C, while a right-side slide member receiving space 13*b* is formed on the inside of the right side wall 12*b* of the outer housing part 12 as clearly shown in FIGS. 1A, 1B, 5A, 6B, 7A, and 8C. The left-side slide member receiving space 13*a* and right-side slide member receiving space 13*b* respectively pass through the outer housing part 12 by extending in a direction orthogonal to the direction of mating with the mating connector 50, i.e., extending in the forward-rearward direction (direction orthogonal to the plane of page in FIG. 1B). Moreover, a pair of attachment parts 14 for the attachment of the lever 30 is formed at the upper end of the rear end portion (left end portion in FIG. 1A) of the housing 10 so as to protrude upward. Support parts 14*a* that respectively support the pivoting shafts 33 of the lever 30 are respectively provided on the attachment parts 14. In addition, as is shown in FIGS. 4 and 5A, temporary locking parts 18 onto which the temporary locking projections 36 of the lever 30 latch when this lever 30 is located in the initial position are respectively provided on the attachment parts 14. Furthermore, as is most clearly shown in FIG. 4, main locking parts 19 are provided at the upper end of the front portion of the housing 10, and main locking projections 35*a* provided on the lever 30 latch on these main locking parts 19 when this lever 30 is located in the final position. Moreover, as is most clearly shown in FIG. 4, a guide part 17 that guides the bundle of electrical wires that are led out from the electrical wire lead-out holes 11*a* upward is provided on the front portion of the housing 10. In addition, as is shown in FIGS. 5B and 6B, a plurality of introduction grooves 16*a* and 16*b* where the drive projections 53 provided on the mating connector 50 respectively enter are formed on the insides of the left side wall 12*a* and right side wall 12*b*, respectively, of the outer housing part 12 of the housing 10 along the forward-rearward direction of these side walls. Furthermore, as is most clearly shown in FIG. 1B, an annular seal 15 is provided around the mating part 11.

Figure 15A:
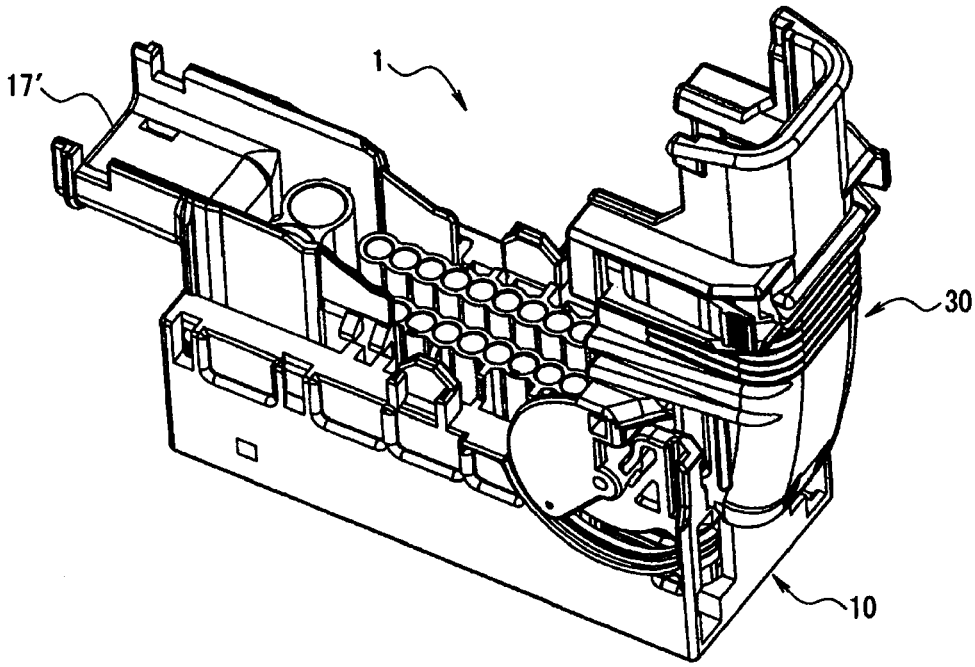
FIG. 15A is a perspective view as seen from above at an angle from the right side surface of a modified guide part showing the lever in the initial position.
Figure 15B:
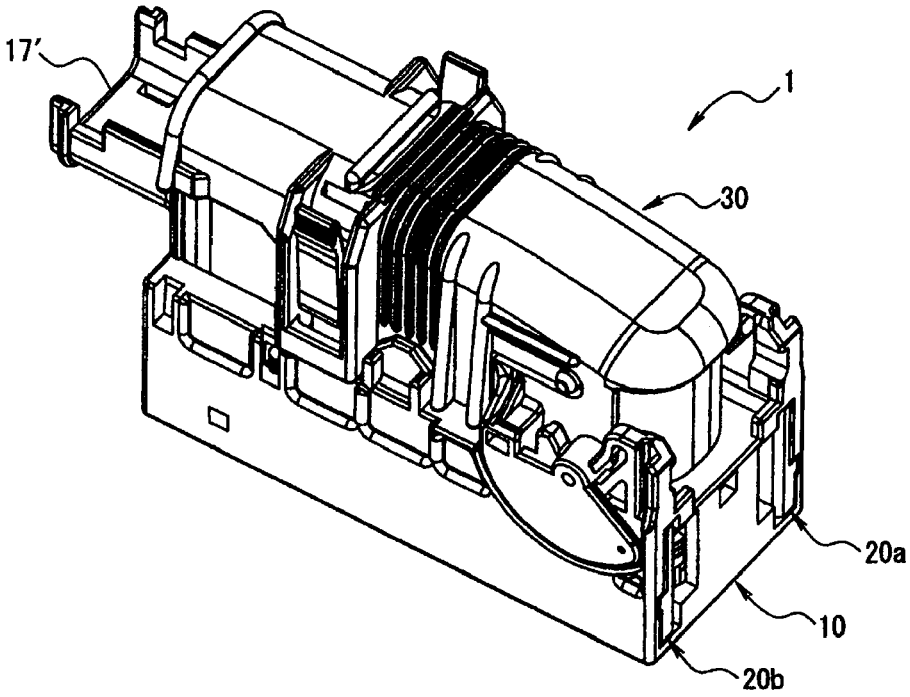
FIG. 15B is a perspective view as seen from above at an angle from the right side surface of a modified guide part showing the lever located in the final position.
Figure 16:
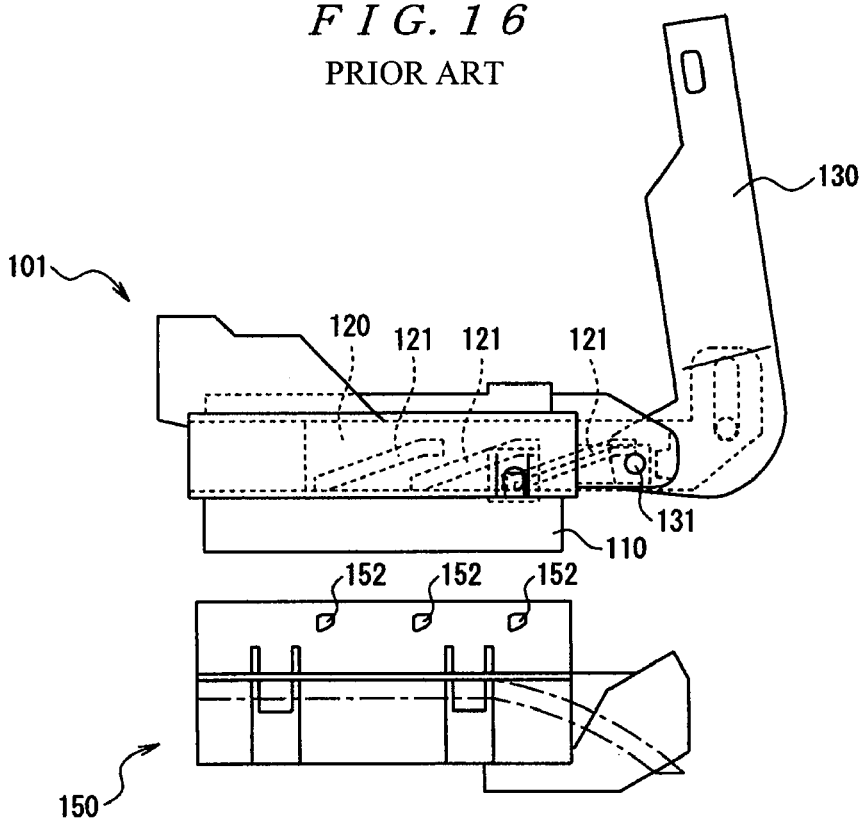
FIG. 16 PRIOR ART
FIG. 16 is a side view showing a conventional lever-type connector and a mating connector that mates with this lever-type connector.
Figure 17:
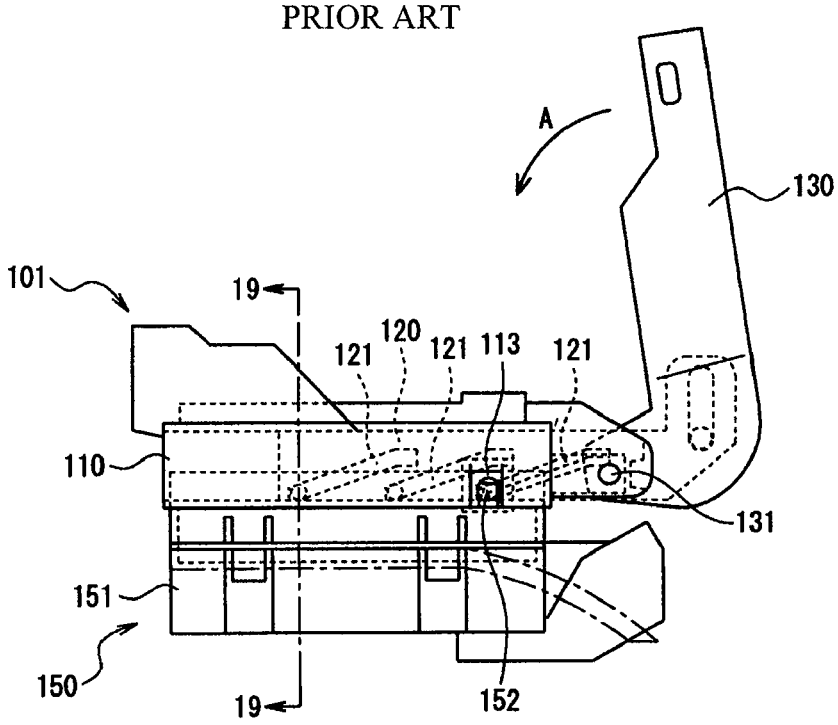
FIG. 17 PRIOR ART
FIG. 17 is a side view showing a state in which the lever-type connector and mating connector shown in FIG. 16 temporarily mate with each other.
Figure 18:
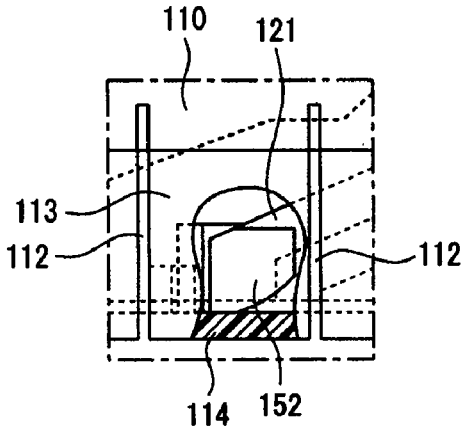
FIG. 18 PRIOR ART
FIG. 18 is an enlarged view in the vicinity of the entrance of a cam groove when the lever-type connector and mating connector shown in FIG. 16 temporary mate with each other.
Figure 19:
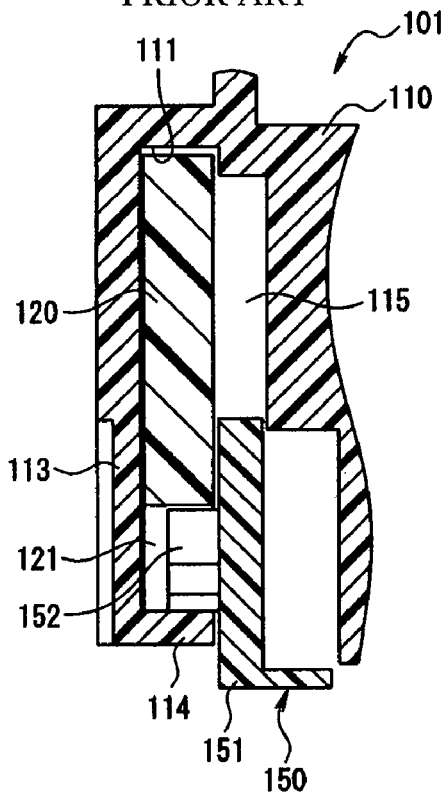
FIG. 19 PRIOR ART
FIG. 19 is a partial sectional view along line 19-19 in FIG. 17.

The guide part 17 is not limited to a case in which this guide part 17 guides the bundle of electrical wires that are led out from the electrical wire lead-out holes 11*a*upward, and may also be formed as a guide part 17' that leads the bundle of electrical wires out in the forward direction (in the leftward direction in FIG. 15A) as shown in FIGS. 15A and 15B.

Figure 1A:
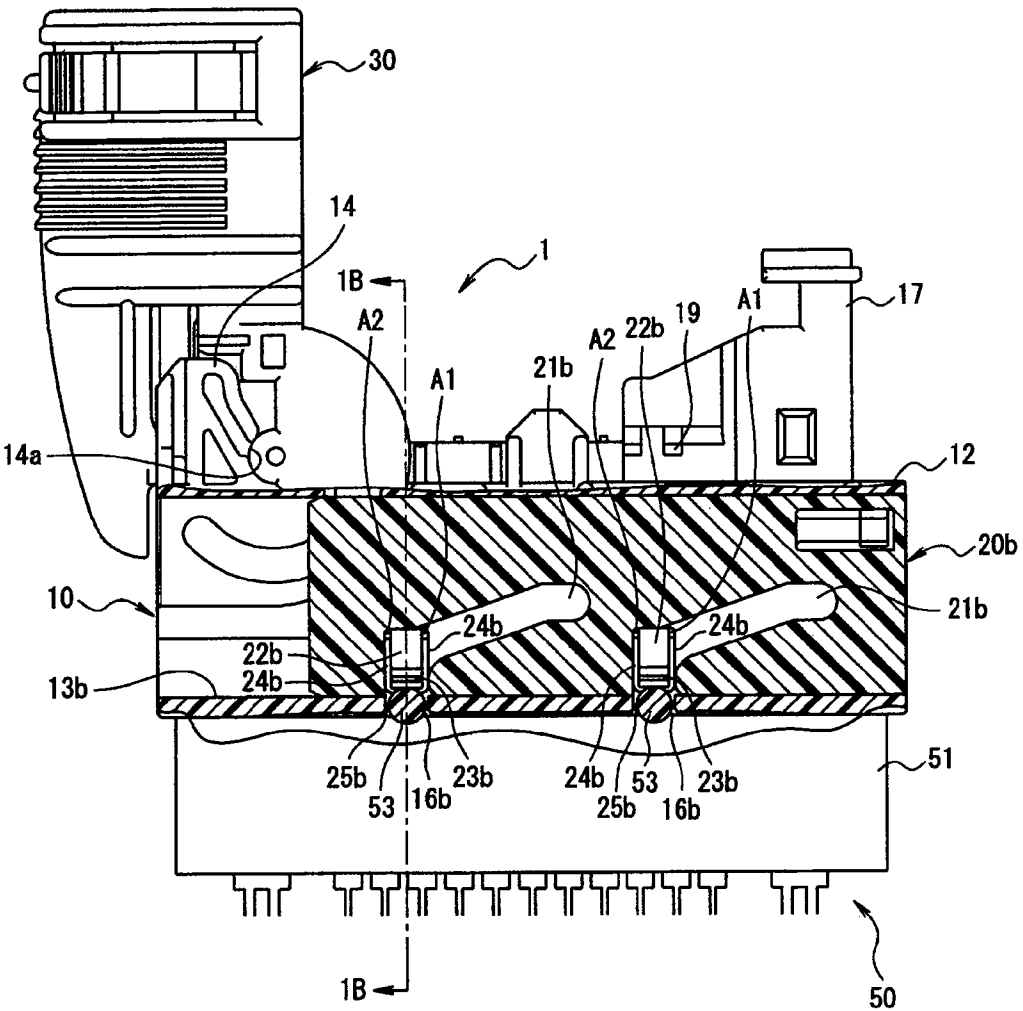
FIG. 1A is a sectional view at initial mating which is cut along the forward-rearward direction.
Figure 2B:
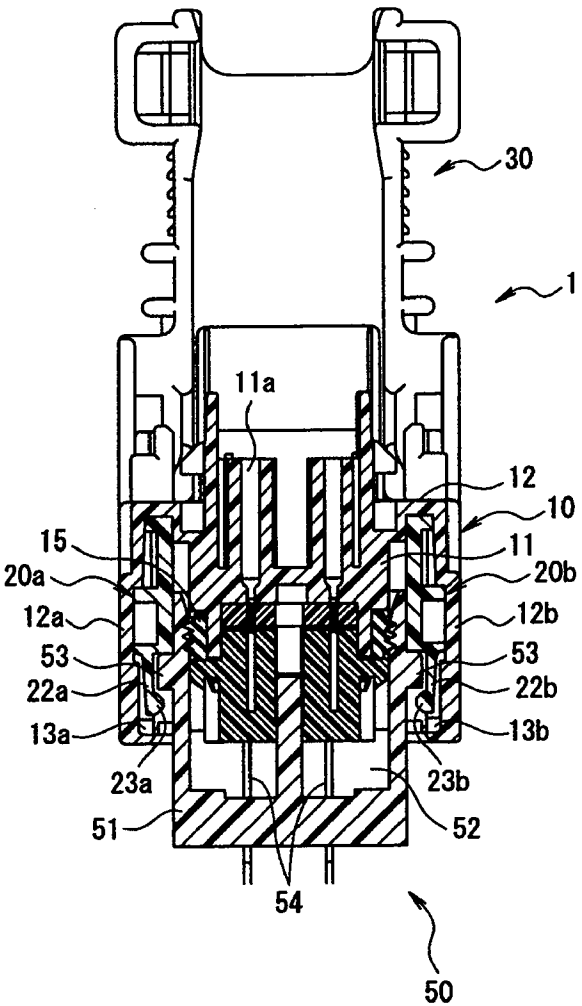
FIG. 2B is a sectional view along line 2B-2B in FIG. 2A.
Figure 2A:
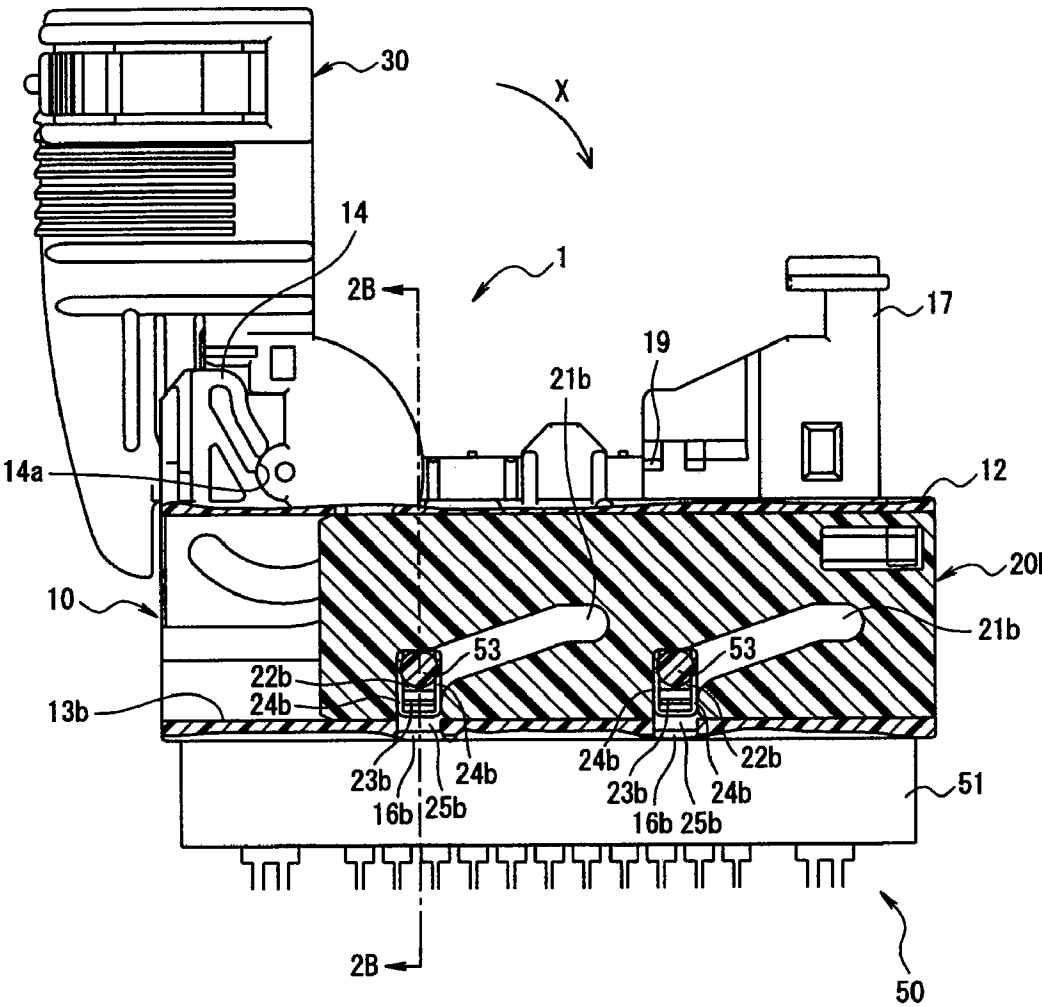
FIG. 2A is a sectional view at temporary mating which is cut along the forward-rearward direction.
Figure 3B:
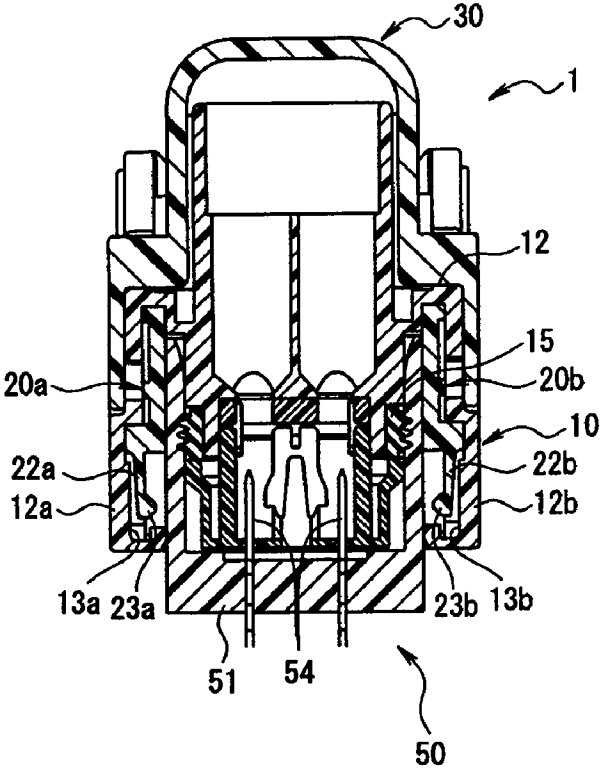
FIG. 3B is a sectional view along line 3B-3B in FIG. 3A.
Figure 3A:
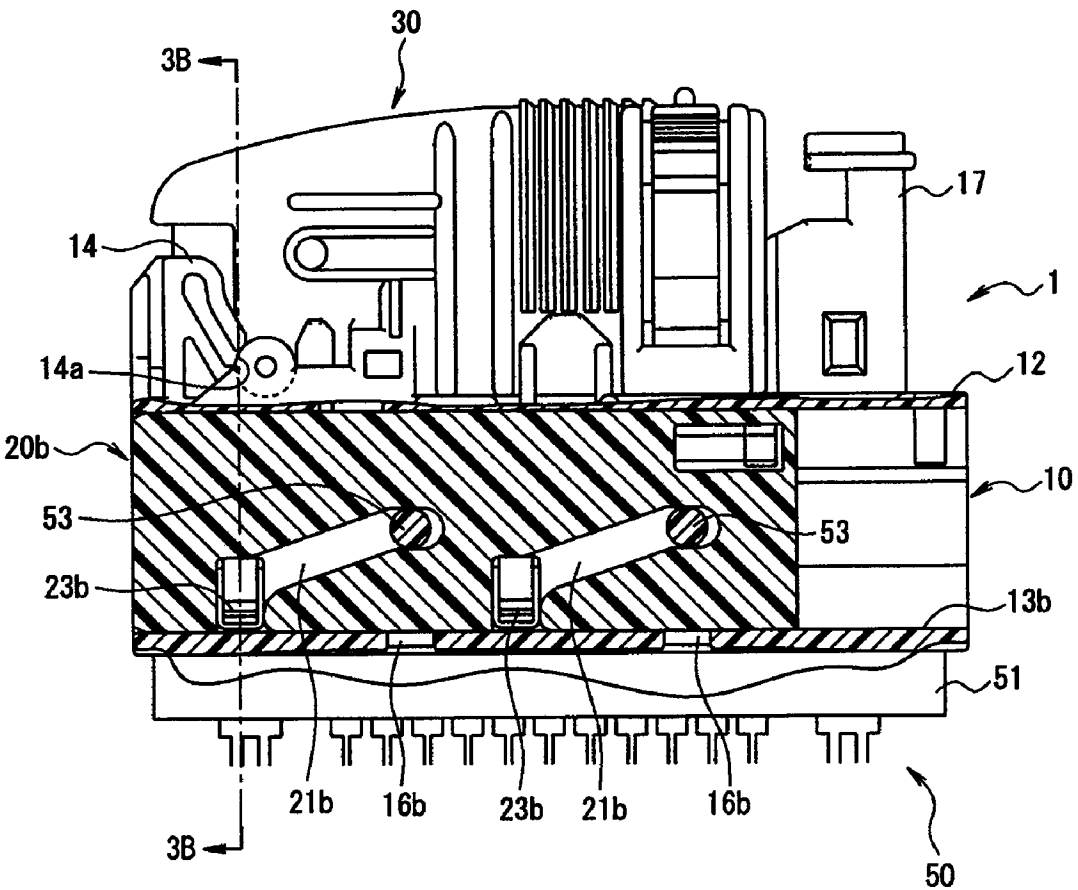
FIG. 3A is a sectional view when mated which is cut along the forward-rearward direction.

The set of two slide members, i.e., left and right slide members 20*a* and 20*b*, are respectively inserted into the left-side slide member receiving space 13*a* and right-side slide member receiving space 13*b*, and move in the forward-rearward direction between the initial position shown in FIGS. 1A and 2A and the final position shown in FIG. 3A. Only the right-side slide member 20*b* is shown in FIGS. 1A, 2A, and 3A.

Because the left-side slide member 20*a* and right-side slide member 20*b* are formed in shapes that show mirror symmetry as shown in FIG. 4, only the construction of the right-side slide member 20*b* will be described hereinafter.

The slide member 20*b* is formed by molding a resin material that has elasticity and high resistance to wear, such as PBT. The slide member 20*b* is formed substantially in a plate form as shown in FIGS. 4 and 14A through 14H. The slide member 20*b* is received inside the right-side slide member receiving space 13*b* as shown in FIGS. 1A, 2A, and 3A. A plurality of cam grooves 21*b* are formed in the inner surface of the slide member 20*b* as shown in FIGS. 14B and 14D. A drive projection 53 provided on the mating connector 50 engages with each of the cam grooves 21*b* as shown in FIGS. 1A, 2A, and 3A. Furthermore, as is shown in FIG. 1A, a plurality of entrances 25*b* are respectively provided for the cam grooves 21*b*, with these entrances 25*b* respectively facing the introduction grooves 16*b* formed in the housing 10 when the slide member 20*b* is located in the initial position. Each of the entrances 25*b* extends from an end portion of each cam groove 21*b* to the lower end edge of the slide member 20*b*, so that the corresponding drive projection 53 enters therefrom. Moreover, as is shown in FIGS. 1A and 14D, resilient latch arms 22*b* are provided on the slide member 20*b*, with each of these resilient latch arms 22*b* being formed between a pair of slits 24*b*, wherein slits 24*b* respectively extending from specified points A1 and A2 which are located in the end portion of one of the cam grooves 21*b* toward the corresponding entrance 25*b* and on the side (upper side) opposite from the side of the entry of the corresponding drive projection 53 (lower side). In the present embodiment, the specified points A1 and A2 are set at the upper end edge of the end portion of each cam groove 21*b* toward the corresponding entrance 25*b*. Each of the resilient latch arms 22*b* elastically deforms in the direction of thickness of the slide member 20*b*. As is shown in FIGS. 2A and 14D, latching projections 23*b* that latch on the corresponding drive projections 53 provided on the mating connector 50 are respectively provided at the tip ends of the resilient latch arms 22*b*. The respective latching projections 23*b* are positioned further toward the interior (upper side) of the end edge of the slide member 20*b* on the side of the entry of the drive projections 53 (lower side).

Figure 14A:
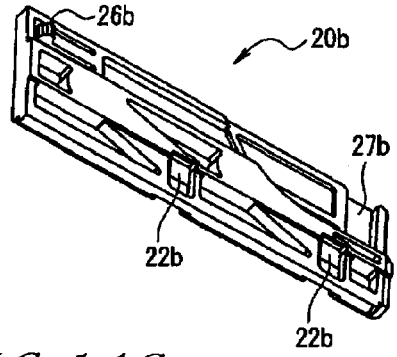
FIG. 14A is a perspective view of the right-side slide member as seen from below at an angle from the right side surface.
Figure 14B:
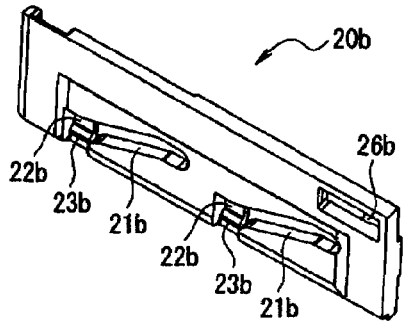
FIG. 14B is a perspective view of the right-side slide member as seen from above at an angle from the left side surface.
Figure 14C:
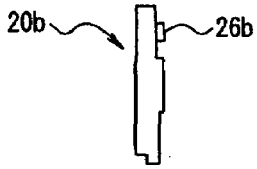
FIG. 14C is a front view of the right-side slide member.
Figure 14D:
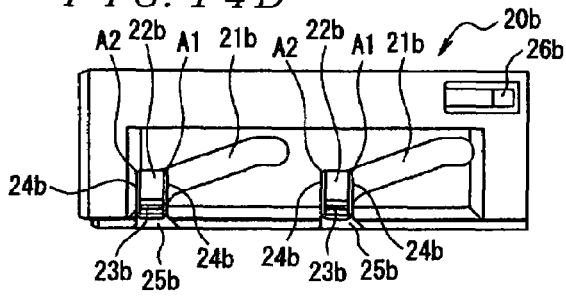
FIG. 14D is a left side view of the right-side slide member.
Figure 14E:
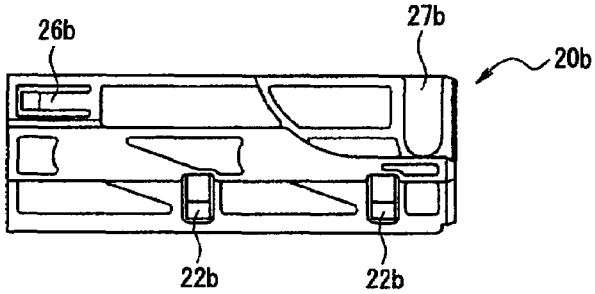
FIG. 14E is a right side view of the right-side slide member.
Figure 14F:
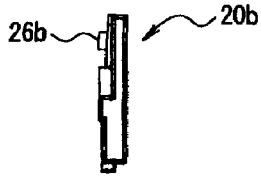
FIG. 14F is a rear view of the right-side slide member.
Figure 14G:
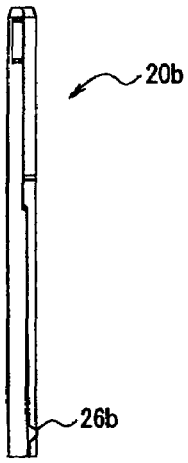
FIG. 14G is a plan view of the right-side slide member.
Figure 14H:
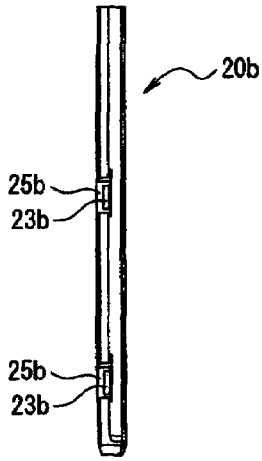
FIG. 14H is a bottom view of the right-side slide member.

In addition, a latch arm 26*b* that is capable of elastic deformation is provided on the outer surface of the slide member 20*b* as shown in FIGS. 14A through 14G. This latch arm 26*b* latches on the right side wall 12*b* of the outer housing part 12 of the housing 10 when the slide member 20*b* is located in the initial position and final position. This prevents the lever 30 from wiggling around when the slide member 20*b* is located in the initial position and final position. Moreover, a groove 27*b* that extends from the upper end edge toward the center of the slide member 20*b* is formed in the outer surface of the slide member 20*b* as shown in FIGS. 4, 14A, and 14E. A drive pin 34 provided on the lever 30 shown in FIG. 4 enters this groove 27*b*.

Furthermore, in FIGS. 4 and 13A through 13H, the symbol 21*a* indicates the cam grooves formed in the left-side slide member 20*a*, 22*a* indicates the resilient latch arms, 23*a* indicates the latching projections, 24*a* indicates the slits, 25*a* indicates the entrances of the cam grooves, and 26*a* indicates the latch arm.

Next, the lever 30 has both the function of driving both the left-side and right-side slide members 20*a* and 20*b* and the covering function which protects the bundle of electrical wires that are led out from the electrical wire lead-out holes 11*a* and which leads this bundle of electrical wires out toward the guide part 17. This lever 30 comprises a hood-type cover part 31 and a pair of extension parts 32 extending from either side of the cover part 31 as shown in FIG. 4. A pair of pivoting shafts 33 that is supported in a pivotable manner on the support parts 14*a* of the housing 10 is formed on the cover part 31 in the vicinity of the extension parts 32 so as to protrude inward. The lever 30 pivots from the initial position shown in FIG. 1A to the final position shown in FIG. 3A as a result of the pivoting shafts 33 being supported in a pivotable manner on the support parts 14*a*. In addition, a pair of drive pins 34 that enters the grooves 27*a* and 27*b* formed in the left-side and right-side slide members 20*a* and 20*b* are formed respectively on the extension parts 32 so as to protrude inward. When the lever 30 pivots from the initial position to the final position, the left-side and right-side slide members 20*a* and 20*b* are respectively pulled by the drive pins 34 from the initial position and move rearward to the final position. Conversely, when the lever 30 pivots from the final position to the initial position, the left-side and right-side slide members 20*a* and 20*b* are respectively pushed by the drive pins 34 from the final position and move forward to the initial position.

Furthermore, as is shown in FIG. 4, a pair of temporary locking projections 36 (only one is shown in FIG. 4) is formed on side surfaces of the cover part 31 of the lever 30 so as to protrude outward. These temporary locking projections 36 latch on the temporary locking parts 18 of the housing 10 when the lever 30 is in the initial position. Moreover, a pair of main locking arms 35 is provided on side surfaces of the cover part 31 of the lever 30 as clearly shown in FIG. 4. Main locking projections 35*a* that latch on the main locking parts 19 provided on the housing 10 when the lever 30 is in the final position are respectively formed at the ends of the main locking arms 35 on one side so as to protrude inward, while operating parts 35*b* are respectively provided at the other ends.

Next, operation of the lever-type connector I will be described. First, in a state in which the assembly of the lever-type connector 1 has been completed, the lever 30 and the left-side and right-side slide members 20*a* and 20*b* are located in the initial position as shown in FIGS. 1A and 1B (only the right-side slide member is shown in FIG. 1A). Because the left-side and right-side slide members 20*a* and 20*b* operate in the same manner, only the operation of the right-side slide member 20*b* will be described hereinafter.

In a state in which the slide member 20*b* is located in the initial position, the entrances 25*b* of the slide member 20*b* respectively face the introduction grooves 16*b* formed in the housing 10 as shown in FIG. 1A. The mating part 11 is inserted into the mating part receiving recess 52 of the mating connector 50 by moving the lever-type connector 1. Then, as is shown in FIGS. 1A and 1B, the mating housing 51 of the mating connector 50 enters the space between the mating part 11 and the outer housing part 12 of the lever-type connector 1, and the drive projections 53 provided on the right side of the mating housing 51 respectively pass through the introduction grooves 16*b* of the housing 10 and the entrances 25*b* of the slide member 20*b*, and are positioned just before the latching projections 23*b* of the resilient latch arms 22*b*.

Moreover, when the lever-type connector 1 is moved further toward the interior, the latching projections 23*b* of the resilient latch arms 22*b* respectively ride over the corresponding drive projections 53 provided on the mating housing 51, and are positioned underneath the drive projections 53 as shown in FIGS. 2A and 2B. As a result, a temporarily mated state is assumed. When the latching projections 23*b* ride over the corresponding drive projections 53, the resilient latch arms 22*b* first elastically deform outward (toward one thickness direction of the slide member 20*b*), and then return to the original position after the latching projections 23*b* have ridden over the corresponding drive projections 53. When the resilient latch arms 22*b* are displaced outward, the resilient latch arms 22*b* undergo deformation inside the right-side slide member receiving space 13*b* (within the scope of the thickness of the slide member 20*b*), and therefore do not contact the right side wall 12*b* of the outer housing part 12. In addition, when the resilient latch arms 22*b* return to the original position as a result of the latching projections 23*b* having ridden over the corresponding drive projections 53, a clear clicking sound is produced, so that the worker can perceive the fact that the connector has reached the temporarily mated state without visually checking the connector. In this temporarily mated state, the latching projections 23*b* of the resilient latch arms 22*b* latch on the corresponding drive projections 53 provided on the mating housing 51, so that the lever-type connector 1 is prevented from dropping out.

Here, during the temporary mating with the mating connector 50, the resilient latch arms 22*b* provided on the slide member 20*b* undergo elastic deformation, and the latching projections 23*b* latch on the corresponding drive projections 53 of the mating connector 50, so that the rigidity of the housing 10 is not lowered. Therefore, oblique insertion into the mating connector 50 can be prevented when the connector is temporarily mated with the mating connector 50. Furthermore, during this temporary mating, the resilient latch arms 22*b* that have the latching projections 23*b* at the tip ends thereof undergo elastic deformation, so that there is no need to provide any latching projection at the end portion of the housing 10 or at the end portion of the slide member 20*b*, and because it is not necessary to cause any flexing of the housing 10 by the insertion into the mating connector 50, the mating operation can be performed easily without requiring a large amount of force.

In addition, each of the resilient latch arms 22*b* is formed between the pair of slits 24*b*, wherein slits 24*b* respectively extending from the specified points A1 and A2 which are located in the end portion of one of the cam grooves 21*b* toward the corresponding entrance 25*b* where the corresponding drive projection 53 enters and on the side opposite from the side of the entry of the corresponding drive projection 53, so that these resilient latch arms 22*b* elastically deform in the direction of thickness of the slide member 20*b*. Specifically, each of the resilient latch arms 22*b* is formed between the pair of slits 24*b*, wherein slits 24*b* respectively extending from the specified points A1 and A2 which are set in the end portion of one of the cam grooves 21*b* toward the corresponding entrance 25*b* and at the upper end edge of this end portion, thus being installed inside this cam groove 21*b*. Furthermore, the resilient latch arms 22*b* elastically deform in the direction of thickness of the slide member 20*b*. Therefore, the necessary amount of displacement of the resilient latch arms 22*b* is ensured within the scope of the thickness of the slide member 20*b* by setting the thickness of the slide member 20*b* larger than the thickness of the conventional slide member (the thickness of the slide member 220 shown in FIG. 20), so that there is no need to increase the length of the resilient latch arms 22*b* in the vertical direction. Consequently, the height of the slide member 20*b* (the length in the vertical direction) can be reduced, which makes it possible to reduce the size of the lever-type connector 1.

Furthermore, as a result of the resilient latch arms 22*b* being installed inside the cam grooves 21*b* and constructed so as to undergo elastic deformation in the direction of thickness of the slide member 20*b*, the degree of freedom in the design of the resilient latch arms 22*b* is increased. Consequently, the portions of the entrances 25*b* of the cam grooves 21*b* of the slide member 20*b* (portions from the lower end edge of the slide member 20*b* to the upper end edges of the cam grooves 21*b*) can be made shorter than in the conventional example shown in FIG. 20. Accordingly, not only can the height of the slide member 20*b* be reduced, but the necessary mating length or stroke can also be ensured while reducing the lever pivoting nucleus from the initiation of the operation of the lever 30 to the beginning of the exhibition of the multiplied force effect, the result being a reduction in free running distance.

Figure 20:
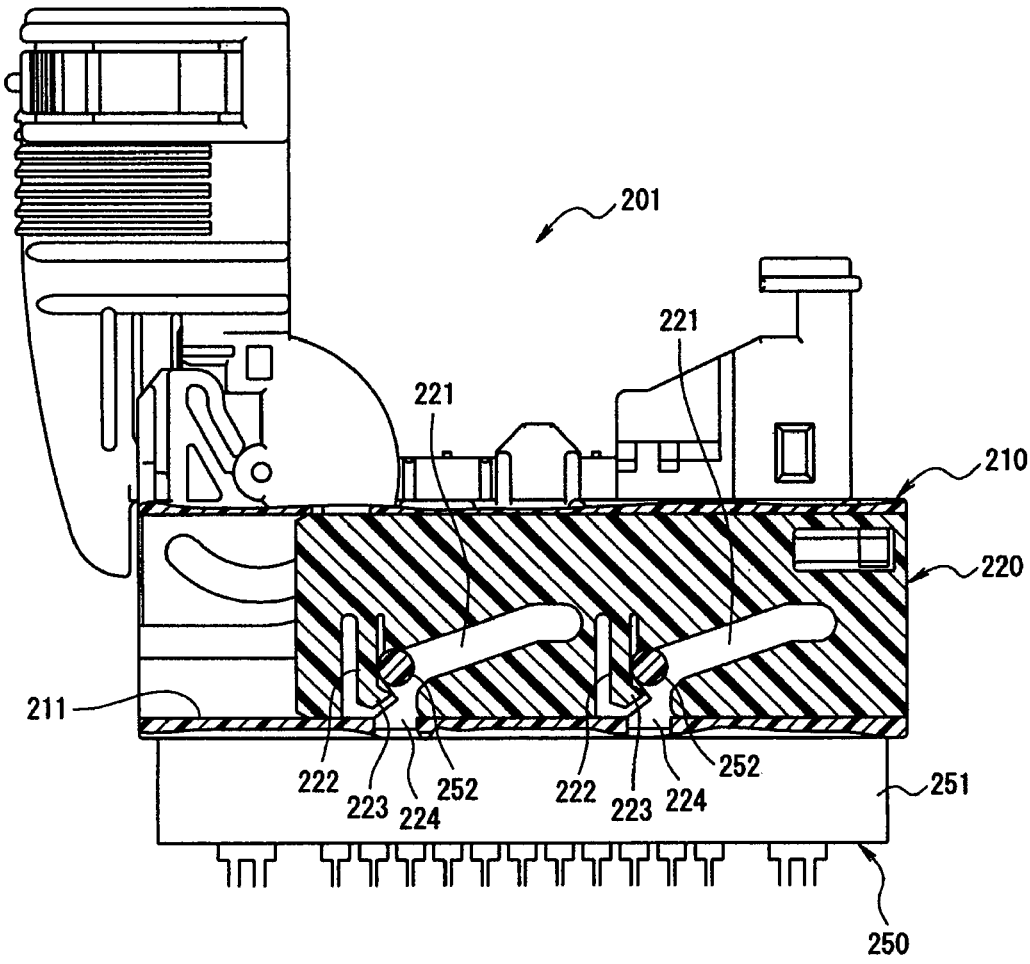
F I G. 2 0 PRIOR ART
FIG. 20 is a sectional view cut along the forward-rearward direction, showing a state in which a conventional lever-type connector temporarily mates with a mating connector.

Moreover, because the degree of freedom in the design of the resilient latch arms 22*b* is increased, the resilient latch arms 22*b* can be constructed more flexibly than in the conventional example shown in FIG. 20. Therefore, the durability of the latching projections 23*b* and drive projections 53 can be increased.

In addition, because the resilient latch arms 22*b* elastically deform in the direction of thickness of the slide member 20*b*, when the latching projections 23*b* of the resilient latch arms 22*b* ride over the corresponding drive projections 53 provided on the mating housing 51, these latching projections 23*b* ride over while sliding over the tops of the drive projections 53. In the conventional example shown in FIG. 20, the resilient latch arms 222 elastically deform in an in-plane direction of the slide member 220, so that the latching projections 223 ride over while sliding over the side surfaces of the drive projections 252. Because the side surfaces of the drive projections 252 constitute the sliding surfaces with the cam grooves 221, it is not desirable to damage the sliding surfaces with the cam grooves 221 by the latching projections 223 sliding over these side surfaces of the drive projections 252. In the present embodiment, on the other hand, the latching projections 23*b* ride over the tops of the drive projections 53, so that there is no such drawback.

Furthermore, the latching projections 23*b* of the resilient latch arms 22*b* are positioned further toward the interior than the end edge of the slide member 20*b* on the side of the entry of the drive projections 53, so that respective spaces can be ensured from the time when the insertion into the mating connector 50 begins until the time when the latching projections 23*b* contact the corresponding drive projections 53. Accordingly, the physical sensation and clicking sound are perceived more clearly when the temporarily mated state is reached as a result of the latching projections 23*b* of the resilient latch arms 22*b* riding over the corresponding drive projections 53 than in a case in which the latching projections 23*b* are provided on the same plane as the end edge of the slide member 20*b* on the side of the entry of the drive projections 53.

Next, when the lever 30 is caused to pivot to the final position in the direction of arrow X in FIG. 2A following the confirmation of the temporarily mated state, the slide member 20*b* is pulled by the drive pins 34, and moves rearward to the final position. As a result, the drive projections 53 respectively slide inside the cam grooves 21*b*, and are pulled into the final position of the cam grooves 21*b*, thus completing mating of the lever-type connector 1 with the mating connector 50 as shown in FIG. 3A. Consequently, the respective contacts of the lever-type connector 1 and the mating contacts 54 of the mating connector 50 make contact with each other, and the electrical connection is established.

Meanwhile, when the lever 30 pivots from the final position to the initial position in the direction opposite from arrow X in FIG. 2A, the slide member 20*b* operates in the opposite manner from what has been described, so that the lever-type connector 1 is released from the mating connector 50.

Here, the angle of the cam grooves 21*b* can be reduced by causing the latching projections 23*b* of the resilient latch arms 22*b* to be positioned further toward the interior than the end edge of the slide member 20*b* on the side of the entry of the drive projections 53, compared to the case in which the latching projections 23*b* are installed on the same plane as the end edge of the slide member 20*b* on the side of the entry of the drive projections 53. Therefore, it is possible to obtain the effects of reducing damage caused by repeated attachment and detachment of the connector and of increasing the durability.

Moreover, because the latching projections 23*b* of the resilient latch arms 22*b* are positioned further toward the interior than the end edge of the slide member 20*b* on the side of the entry of the drive projections 53, the temporarily mated state can be perceived easily, so that it is possible to avoid the erroneous operation of the slide member 20*b* caused by the operation of the lever 30. Specifically, if the latching projections 23*b* of the resilient latch arms 22*b* are located at the same position as the end edge of the slide member 20*b* on the side of the entry of the drive projections 53, the respective clearances from the latching of the latching projections 23*b* on the corresponding drive projections 53 to the entry of the drive projections 53 into the cam grooves 21*b* are large, so that even when the lever 30 is operated in this state, the initial operating load is small. In contrast, if the latching projections 23*b* of the resilient latch arms 22*b* are positioned toward the interior of the end edge of the slide member 20*b* on the side of the entry of the drive projections 53, the respective clearances from the latching of the latching projections 23*b* on the corresponding drive projections 53 to the entry of the drive projections 53 into the cam grooves 21*b* are small, so that the operating load is large from the beginning when the lever 30 is operated in this state. Accordingly, the temporarily mated state can be perceived easily, which makes it possible to avoid erroneous operation of the slide member 20*b* caused by the operation of the lever 30.

An embodiment of the present invention has been described above. However, the present invention is not limited to this embodiment, and various alterations or modifications can be made.

For example, the slide member is not limited to the case of constructing a pair of left-side and right-side slide members 20*a* and 20*b* formed in shapes that show mirror symmetry; the slide member may also be constructed from a single unit in which the left-side and right-side slide members 20*a* and 20*b* are integrated.

Furthermore, it is sufficient if the lever 30 possesses the function of driving the slide members 20*a* and 20*b*, and it is not absolutely necessary to have the function of protecting the bundle of electrical wires that are led out from the electrical wire lead-out holes 11*a* and leading out this bundle of electrical wires to the guide part 17. In this case, it is preferable to provide a separate wire cover that protects the bundle of electrical wires led out from the electrical wire lead-out holes 11*a* and that leads this bundle of electrical wires out to the guide part 17.

Moreover, it is sufficient if the specified points A1 and A2 are positioned in the end portion of each of the cam grooves 21*b* toward the corresponding entrance 25*b* and on the side (upper side) opposite from the side of the entry of the corresponding drive projection 53 (lower side); it is not absolutely necessary to set these specified points A1 and A2 at the upper end edge of the end portion of each cam groove 21*b* toward the corresponding entrance 25*b*.

What is claimed is:

1. A lever-type connector comprising:

a housing having a contact;

a slide member having a cam groove that receives a drive projection of a mating connector on a side;

a lever that drives the slide member;

a resilient latch arm located on the slide member and being formed between a pair of slits respectively extending from specified points located in an end portion of the cam groove toward an entrance where the drive projection enters and on a side opposite from the side of entry of the drive projection so as to elastically deform in a direction of thickness of the slide member; and, a latching projection located at an end of the resilient latch arm such that it latches on the drive projection during temporary mating with the mating connector.

2. The lever-type connector of claim 1, wherein the latching projection of the resilient latch arm is positioned further toward the interior than an end edge of the slide member.

3. The lever-type connector of claim 1, wherein the slide member is received inside slide member receiving spaces of the housing.

4. The lever-type connector of claim 2, wherein the cam groove is formed on an inner surface of the slide member.

5. The lever-type connector of claim 2, wherein the entrance faces an introduction groove of the housing when the slide member is located in an initial position.

6. The lever-type connector of claim 1, wherein the specified points are set at an upper end edge of an end portion of the cam groove.

7. The lever-type connector of claim 1, further comprising a second latch arm located on an outside of the slide member for latching to a side wall of the housing.

8. The lever-type connector of claim 4, further comprising a groove formed on an outer surface of the slide member and extending from an edge toward a center thereof.

9. The lever-type connector of claim 8, wherein the groove receives a drive pin of the lever.

* * * * *